US009027919B2

(12) United States Patent
Fukusaka et al.

(10) Patent No.: US 9,027,919 B2
(45) Date of Patent: May 12, 2015

(54) SHEET FEEDING DEVICE AND IMAGE FORMING APPARATUS

(71) Applicant: Canon Kabushiki Kaisha, Tokyo (JP)

(72) Inventors: Tetsuro Fukusaka, Abiko (JP); Yoshitaka Yamazaki, Abiko (JP); Taishi Tomii, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 126 days.

(21) Appl. No.: 13/709,387

(22) Filed: Dec. 10, 2012

(65) Prior Publication Data

US 2013/0216291 A1 Aug. 22, 2013

(30) Foreign Application Priority Data

Feb. 17, 2012 (JP) ..... 2012-032552

(51) Int. Cl.

| | |
|---|---|
| ***B65H 7/12*** | (2006.01) |
| ***B41J 13/00*** | (2006.01) |
| ***B65H 3/12*** | (2006.01) |
| ***B65H 5/24*** | (2006.01) |

(52) U.S. Cl.

CPC ..... *B41J 13/0009* (2013.01); *B65H 3/128* (2013.01); *B65H 5/24* (2013.01); *B65H 7/125* (2013.01); *B65H 2511/51* (2013.01); *B65H 2511/52* (2013.01); *B65H 2553/30* (2013.01)

(58) Field of Classification Search

USPC ..... 271/258.01, 259, 262, 258.04, 265.01, 271/265.02, 265.04, 110, 111

See application file for complete search history.

(56) References Cited

U.S. PATENT DOCUMENTS

| | | | | |
|---|---|---|---|---|
| 5,421,463 | A * | 6/1995 | Okazaki et al. | 209/559 |
| 6,308,947 | B1 | 10/2001 | Kojima et al. | |
| 6,502,816 | B2 | 1/2003 | Inoue et al. | |
| 7,591,459 | B2 | 9/2009 | Matsumoto et al. | |
| 7,726,214 | B2 * | 6/2010 | Schoen | 73/865.8 |
| 8,210,519 | B2 | 7/2012 | Fukusaka et al. | |
| 8,262,080 | B2 | 9/2012 | Matsumoto et al. | |
| 2006/0145412 | A1 * | 7/2006 | Tagawa et al. | 271/258.01 |
| 2012/0049437 | A1 | 3/2012 | Matsumoto et al. | |
| 2013/0026696 | A1 | 1/2013 | Matsumoto et al. | |
| 2013/0049286 | A1 | 2/2013 | Yamazaki et al. | |

FOREIGN PATENT DOCUMENTS

| | | | |
|---|---|---|---|
| JP | 11-217148 | A | 8/1999 |
| JP | 2000-095390 | A | 4/2000 |
| JP | 3890766 | B2 | 3/2007 |

* cited by examiner

*Primary Examiner* — Michael McCullough

(74) *Attorney, Agent, or Firm* — Fitzpatrick, Cella, Harper & Scinto

(57) ABSTRACT

Provided are a sheet feeding device and an image forming apparatus that are capable of accurately detecting an abnormality of a feeding state without erroneously detecting when a trailing edge of a preceding sheet and a leading edge of a subsequent sheet are fed in an overlaid state. The sheet feeding device includes ultrasonic wave sensors 6 and 7 that detect an overlaid state of a preceding sheet Sa and a subsequent sheet Sb fed from feeding portions 51, 317 to 319 and a controller 1 that continuously performs a detection of the overlaid state of a sheet fed from the feeding portion at a predetermined number of detecting points along a sheet conveying direction at every predetermined time and determines a number of detecting points where detects. Based on the determined number of detecting points, the controller determines that the overlaid state is normal or abnormal.

14 Claims, 14 Drawing Sheets

SHEET FEEDING DEVICE AND IMAGE FORMING APPARATUS

BACKGROUND OF THE INVENTION

1. Field of the Invention

The present invention relates to a sheet feeding device and an image forming apparatus, and more specifically, to a device that separately feeds a sheet by blowing air toward the sheet.

2. Description of the Related Art

An image forming apparatus such as a copying machine includes a sheet feeding device that feeds sheets to an image forming portion. In such a sheet feeding device, it is required to prevent two or more sheets from being fed to the image forming portion in an overlaid state (double feeding state) so as to prevent the image forming error of the sheet.

In the related art, in order not to feed the sheets to the image forming portion in a double feeding state, a device that detects whether the sheets fed from a sheet feeding portion are double fed has been suggested. As the double feeding detecting device, a configuration that includes an ultrasonic transmitter and an ultrasonic receiver that receives an ultrasonic wave transmitted from the ultrasonic transmitter is known. In this double feeding detecting device, the ultrasonic wave is transmitted from the ultrasonic transmitter to a plurality of locations of the sheet and if the number of locations where an attenuation amount of the ultrasonic wave is larger than a reference value is not less than a predetermined number because the sheets are overlaid, it is determined to be a double feeding state (see Japanese Patent No. 3890766).

The double feeding detecting device is applied to a case where a length of a portion where the sheets are overlaid with each other is short and when an ultrasonic wave is irradiated, the ultrasonic wave is irradiated onto a portion where the sheets are not overlaid and it is not determined as double feeding. Further, the double feeding detecting device may also be used when it is not determined as double feeding because the transmittance of the irradiation position of the ultrasonic wave is not obtained in accordance with the attenuance matching to the double feeding detection due to the unevenness of a fiber of the sheet.

In the meantime, further, an overlay conveying apparatus that conveys the sheets which are separately fed one by one with a predetermined interval by the sheet feeding portion to be partially overlaid is known. The overlay conveying apparatus includes a conveyance belt that continuously conveys the sheets, a delivery belt that receives and conveys a sheet which falls from the downstream of the conveyance belt, and a pressing roller that presses a leading edge of a sheet which is inclined between the pressing roller and the conveyance belt.

In the overlay conveying device, the delivery belt is driven at a sufficiently slow speed with respect to the conveyance belt. By doing this, while a trailing edge hangs on the conveyance belt in a state where the leading edge of a preceding sheet hangs on the delivery belt, a subsequent sheet is conveyed in a state where a leading edge of the subsequent sheet is overlaid with the trailing edge of the preceding sheet (see Japanese Patent Laid-Open No. 11-217148).

However, as disclosed in Japanese Patent Laid-Open No. 11-217148, if the double feeding detecting device disclosed in Japanese Patent No. 3890766 is applied to the overlay conveying apparatus that feeds and conveys the sheet while the trailing edge of the preceding sheet is overlaid with the leading edge of the subsequent sheet, the following problems may be caused. Specifically, when the sheets which are continuously conveyed without a space between the sheets are detected by the double feeding detecting device, it is difficult to discriminate a leading edge of a sheet other than the first sheet and to capture an accurate timing to start the irradiation of the ultrasonic wave.

Here, in the double feeding detecting device, a set overlaid amount is previously known so that a result of irradiating the ultrasonic wave onto a location which is predicted as an overlaid portion is not referred to or the ultrasonic wave is not irradiated onto the location which is predicted as an overlaid portion. However, in this case, due to the variation in the overlaid amount, the number of ultrasonic waves which are actually irradiated on the overlaid portion may be larger or smaller than a predetermined number or the ultrasonic wave is or may be irradiated onto the overlaid portion. Accordingly, the overlaid portion may be erroneously detected as double fed portion.

It is desirable to provide a sheet feeding device and an image forming apparatus that are capable of accurately detecting an abnormality of a feeding state without erroneously detecting a normal feeding state of the sheet to be an abnormal state when a trailing edge of a preceding sheet and a leading edge of a subsequent sheet are fed in an overlaid state.

SUMMARY OF THE INVENTION

A sheet feeding device according to the present invention includes: a tray that supports a sheet so as to be lifted and lowered; a feeding portion that feeds the sheet in a state where an upstream edge in a feeding direction of a preceding sheet fed from the tray is overlaid with a downstream edge in a feeding direction of a subsequent sheet; a detecting portion that detects an overlaid state of the preceding sheet and the subsequent sheet that are fed from the feeding portion; and a controller that continuously detects the overlaid state of the sheet fed from the feeding portion at a predetermined number of detecting points along the sheet feeding direction at every predetermined time, determines the number of detecting points that detect the overlaid state, determines that the overlaid state is normal if the number of detecting points is in a predetermined range in which the number is equal to or larger than a first number and equal to or smaller than a second number which is larger than the first number based on the determined number of detecting points and determines that the overlaid state is abnormal if the number of detecting points is out of the predetermined range.

According to the present invention, based on the detection result of the overlaid state, it is possible to determine to be normal if the state of the overlaid portion of the sheets is within a predetermined range and to be abnormal if the state is out of the predetermined range. Therefore, it is possible to accurately discriminate the overlaid state. By doing this, an intentional accurate overlaid portion is not erroneously detected as an unintentional inaccurate overlaid portion so that it is possible to stably feed the sheets from the feeding portion in an overlaid state.

Further features of the present invention will become apparent from the following description of exemplary embodiments with reference to the attached drawings.

DESCRIPTION OF THE EMBODIMENTS

Figure 1:
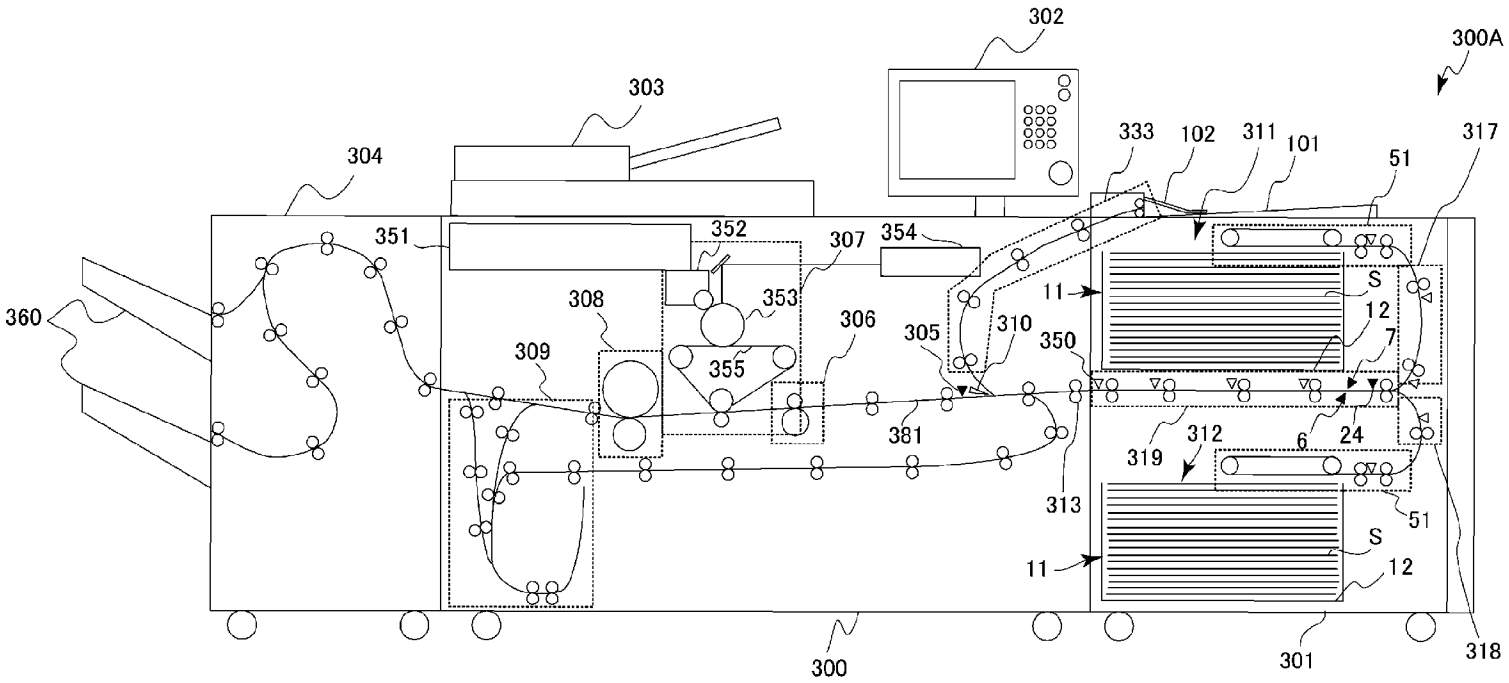
FIG. 1 is a schematic configuration view of an image forming apparatus including a sheet feeding device according to an embodiment of the present invention.

Hereinafter, exemplary embodiments of the present invention will be described in detail with reference to accompanying drawings. FIG. 1 is a schematic configuration view of an image forming apparatus including a sheet feeding device according to an embodiment of the present invention.

In FIG. 1, an image forming apparatus 300A is configured by an image forming apparatus main body (hereinafter, referred to as a main body) 300, an operation portion 302, a sheet feeding unit 301, and a sheet processing apparatus 304. The feeding and conveying of a sheet, image forming, and stapling are performed based on a sheet processing set in the operation portion 302 or an external host PC which is not illustrated by a user and image information sent from a reader scanner 303 or the external host PC. The sheet is output as a resultant to be provided to the user. Further, a downstream device according to an embodiment of the present invention is configured by the main body 300 and a display according to an embodiment of the present invention is configured by the operation portion 302. Further, the sheet processing apparatus 304 configures a sheet processing portion and a post-processing portion according to an embodiment of the present invention.

First Embodiment

The sheet feeding unit 301 includes upper and lower sheet feeding devices 311 and 312. In each of the sheet feeding devices 311 and 312, a sheet storage case 11 and 11 that stores a sheet bundle and a suction conveying mechanism 51 and 51 that feeds the sheet stored in the sheet storage case 11 and 11 are provided. In the embodiment, the suction conveying mechanisms 51 and 51 use an air feeding system and feed the sheet while sucking the sheet at an endless belt at the time of sheet feeding operation.

Here, in order to maintain a sheet feeding productivity even when the feeding speed is lowered in order to save energy and reduce an operation noise in accordance with sheet request information from the main body 300, the sheet feeding unit 301 operates as follows. Specifically, in a state where a trailing edge of a precedently fed sheet is sequentially overlaid with a leading edge of a subsequently fed sheet, the sheets are sequentially fed and conveyed from the sheet storage cases 11 and 11. A leading sheet is conveyed to a conveyance sensor 350 which is a delivery portion with the image forming apparatus 300A, and after completing the conveyance, it is notified that the sheet is ready to be delivered from the sheet feeding unit 301 to the main body 300.

The main body 300 receives the notification of readiness from the sheet feeding unit 301 and notifies the sheet feeding unit 301 of the delivery request. The sheet feeding unit 301 sequentially conveys overlaid sheets to the main body 300 for every notification of the delivery request. In this case, a sheet conveying speed in the main body 300 is set to be twice or higher than a sheet conveying speed in the sheet feeding unit 301. The main body 300 pulls out the sheets from the sheet feeding unit 301 in order to separate the sheets one by one to sequentially form images.

At a time when the leading edge delivered from the sheet feeding unit 301 reaches a conveying roller 313 which is on the top of the main body 300, a preceding sheet among the sheets overlaid by the conveying roller of the main body 300 is pulled out to be separated and conveyed. At a time when sheets as many as they are requested by the main body 300 are overlaid to be fed, the sheet feeding unit 301 completes the feeding operation. The operation is completed after separating, pulling out, and discharging the overlaid sheet group by the main body 300 and then the sheet feeding unit 301 is in a standby state to be ready for a next delivery request from the main body 300.

The sheet conveyed by the suction conveying mechanism 51 of the upper sheet feeding device 311 is fed to the main body 300 via an upper conveying portion 317 and a merged conveying portion 319. Further, the sheet conveyed by the suction conveying mechanism 51 of the lower sheet feeding device 312 is fed to the main body 300 via a lower conveying portion 318 and the merged conveying portion 319. Further, conveying stepping motors which are not illustrated are provided in the conveying portions 317 to 319 and these motors are controlled by a conveying controller (not illustrated) to rotate the conveying roller of each of the conveying portions to feed the sheet. The driving of the stepping motor of each of the conveying portions is mechanically transmitted to rotate the conveying roller of each of the portions to convey the sheet. Further, a feeding portion according to the embodiment of the present invention that feeds the sheet in a state where a downstream edge in a feeding direction of a subsequent sheet is overlaid with an upstream edge in a feeding direction of a preceding sheet fed from a tray 12 is configured by the suction conveying mechanism 51, the upper conveying portion 317, the lower conveying portion 318, and the merged conveying portion 319.

Further, the merged conveying portion 319 includes a transmission side ultrasonic wave sensor 6 and a reception side ultrasonic wave sensor 7 as double feeding detecting sensors which are opposite to each other with a conveying path therebetween.

Further, on a top surface of the sheet feeding unit 301, an escape tray 101 that compulsively discharges an abnormal sheet due to double feeding or jam is disposed. A fully stacked state detecting sensor 102 is configured to detect a fully stacked state of sheets to be discharged to the escape tray 101. On a conveying path of the sheet feeding unit 301, a plurality of displacement sensors for each pair of rollers is provided so as to detect the passage of the leading edge and the trailing edge of the sheet in each conveying path.

If an abnormality of a sheet to be conveyed such as double feeding or delay jam (delay overlaid state) is detected, a switching member 310 operates so as to select an escape conveying path 333 to the escape tray 101. If the sheet is in a normal state, the switching member 310 operates so as to select a conveying path 381 to an image creating portion 307. In contrast, if the sheet is in an abnormal state, the switching member 310 operates so as to discharge the sheet to the escape tray 101. If the sheet is in a normal state, as an image reference sensor 305 detects a sheet, an image forming operation is performed based on image data received in the image creating portion 307. The image creating portion 307 configures the sheet processing portion and the image forming portion according to the embodiment of the invention.

In the embodiment, as described above, the escape conveying path 333 which discharges the sheet from the feeding portion which is configured by the suction conveying mechanism 51, the upper conveying portion 317, the lower conveying portion 318, and the merged conveying portion 319 to the outside of the device is provided. If it is determined that the overlaid state of the sheets is normal, a CPU 1 serving as a controller which will be described below continues the feeding operation of the feeding portion. In contrast, if it is determined that the overlaid state is abnormal, the CPU stops feeding of the sheet to the downstream of the feeding portion and sends the preceding sheet and the subsequent sheet thereof which are determined to be abnormal to the escape conveying path 333.

Further, in the embodiment, even though the escape conveying path 333 that discharges the sheets to the escape tray 101 is disposed in the main body 300, the escape conveying path 333 may be disposed in the sheet feeding unit 301.

The feeding operation is performed by the suction conveying mechanisms 51 and 51 provided in each feeding portion. In the suction conveying mechanisms 51 and 51, a plurality of fans to be described below which controls air-sheet feeding is disposed. The suction conveying mechanisms 51 and 51 control the fans in order to feed air between the sheets S in the sheet storage cases 11 and 11 from the downstream of the conveying direction at the time of feeding operation. If the sheet S is loosen, the sheet is stuck to a suction conveying belt 21 by suction from a suction opening 34*a* which is disposed in the endless belt shaped suction conveying belt 21, which will be described below, and a part of the preceding sheet and a part of the subsequent sheet are overlaid to be fed and conveyed. The suction conveying belt 21 configures a suction conveying member that sucks and conveys the sheet S floated by the driving of an air blowing portion 29. The details of the overlay conveying operation of the suction conveying mechanisms 51 and 51 will be described below.

The main body 300 forms an image on a sheet S fed by the sheet feeding unit 301. On a top surface of the main body 300, the operation portion 302 which allows a user to set an operation for the image forming apparatus 300A (image forming system) is provided. Further, in the upper portion of the main body 300, the reader scanner 303 that reads an original image is disposed. The main body 300 includes the image creating portion (sheet processing portion) 307 as an image forming portion including a photosensitive drum 353, a laser scanner unit 354, a developing portion 352, and an intermediate transfer belt 355, a fixing portion 308, and a reverse conveying portion 309.

The operation portion 302 may serve as a display which is disposed on the main body 300 as described above to display the state of the image forming apparatus 300A or serve as a display which is disposed on the sheet feeding unit 301 to display the device state of the sheet feeding unit 301 (sheet feeding devices 311 and 312).

After receiving the sheet from the sheet feeding unit 301, the main body 300 controls the conveying portions to convey the sheet and performs the image forming operation based on the image data received by the image creating portion 307 as the sheet is detected by the image reference sensor 305.

Here, at the time of image forming operation, if the image reference sensor 305 detects a sheet, a semiconductor laser in the laser scanner unit 354, which is not illustrated, is controlled to be on/off and a light quantity thereof is controlled. Further, a scanner motor that controls a polygon mirror, which is not illustrated, to be rotated is controlled. By doing this, the laser light based on the image data is irradiated onto the photosensitive drum 353 and a latent image is formed on the photosensitive drum 353.

Next, in the developing portion 352, a toner is fed from a toner bottle 351 to develop the latent image on the photosensitive drum 353 and the developed toner image is primarily transferred onto the intermediate transfer belt 355 by the photosensitive drum 353.

Thereafter, the toner image transferred onto the intermediate transfer belt 355 is secondarily transferred onto the sheet so that a toner image is formed on the sheet. A registration controller 306 is provided immediately front of the secondary transfer position. The registration controller 306 corrects a skew feeding of a sheet which is immediately front of the transfer position or controls the conveyance of the sheet by finely adjusting the toner image formed on the intermediate transfer belt 355 and the leading edge position of the sheet without stopping the sheet.

Next, the sheet which is secondarily transferred is conveyed to the fixing portion 308 and heat and a pressure are applied onto the sheet in the fixing portion 308 so that the toner is melted and fixed onto the sheet. If a printing operation (image forming) is continuously performed on a rear surface of the sheet or a top surface and a rear surface of the sheet are reversed, a sheet on which the fixing operation is completed is conveyed to the reverse conveying portion 309. If the printing operation is completed, the sheet is conveyed to a downstream sheet processing apparatus 304. The sheet processing apparatus 304 is connected to a downstream of the image forming apparatus 300A and performs a predetermined processing (bending, stapling, or punching) set by the user through the operation portion 302 on the sheet on which an image is formed, discharged from the main body 300. Thereafter, the sheets as a resultant are sequentially output to any one of discharging trays 360 to be provided to the user. The sheet processing apparatus 304 configures a sheet processing portion which is a post-processing portion that performs a post processing on the sheet on which an image is formed.

Figure 2:
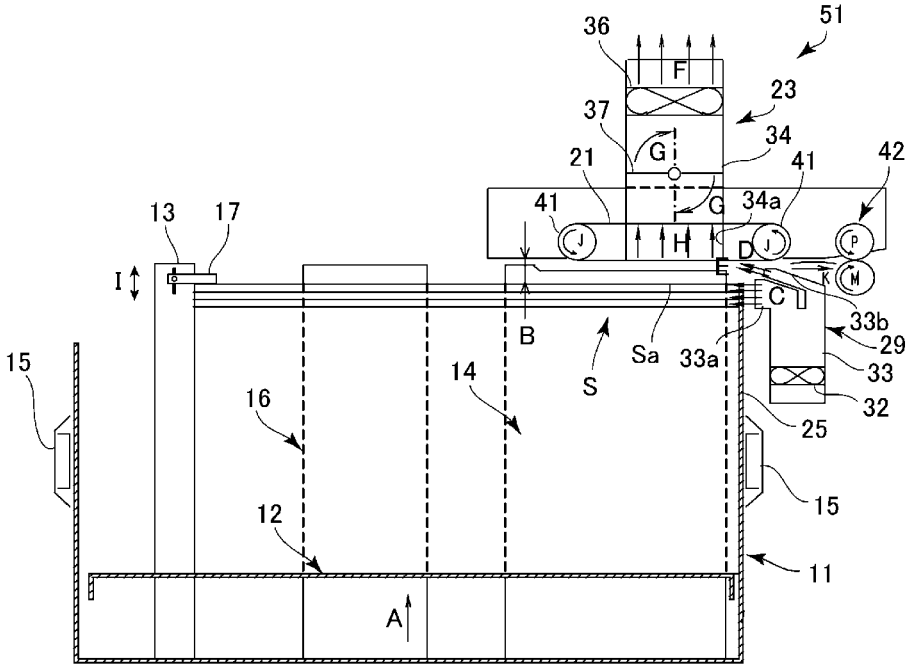
FIG. 2 is a cross-sectional view illustrating a configuration of a lower sheet feeding device in a sheet feeding unit of the image forming apparatus.

Next, a schematic configuration of the upper and lower sheet feeding devices 311 and 312 of the sheet feeding unit 301 to which this invention is applied will be described with reference to FIG. 2. FIG. 2 is a view illustrating the configuration of the lower sheet feeding device 312 in the sheet feeding unit 301. Since the upper sheet feeding device 311 has the same configuration as the lower sheet feeding device 312, the description of the configuration of the upper sheet feeding device 311 may be substituted with the description of the lower sheet feeding device 312.

As illustrated in FIG. 2, the sheet storage case 11 disposed in the lower sheet feeding device 312 has a tray 12 on which a plurality of sheets S is loaded (that is, a tray 12 that supports the sheets S to lift or lower the sheets S). The sheet storage case 11 further has a trailing edge regulating plate 13 that regulates a trailing edge which is an upstream edge in a sheet feeding direction (a horizontal direction in FIG. 2). Further, the sheet storage case 11 includes a leading edge regulating plate 25 that regulates the leading edge which is an end of the downstream in the sheet feeding direction of the sheet S and side edge regulating plates 14 and 16 that regulate a position of a width direction (horizontal direction) perpendicular to the sheet feeding direction of the sheet S. The sheet storage case 11 further includes slide rails 15 and 15 which are disposed upstream and downstream of the sheet feeding direction.

Above the trailing edge regulating plate 13, a sheet trailing edge pressing member 17 as a pressure member that presses the trailing edge of the uppermost sheet Sa to separate the sheet is provided so as to be slidable up and down and rotatable. The sheet trailing edge pressing member 17 also functions as a trailing edge sheet surface detecting sensor (17) which is provided in a sheet surface position of the trailing edge regulating plate 13.

The trailing edge sheet surface detecting sensor 17 disposed in the sheet surface position of the trailing edge regulating plate 13 moves along the sheet surface position in a direction of an arrow I (vertical direction) in FIG. 2 and detects a sheet surface height position when the sheet S is floated by a blowing fan 32.

The sheet storage case 11 may be pulled out from the sheet feeding unit 301 through the slide rail 15. When the sheet storage case 11 is pulled out to the front side of FIG. 2, the tray 12 is lowered to a predetermined position to supplement or exchange the sheets. Further, above the sheet storage case 11, the suction conveying mechanism 51 using an air feeding system for separately feeding the sheets S one by one is disposed.

The suction conveying mechanism 51 includes a suction conveying portion 23 that sucks and conveys the sheet loaded in the tray 12, an air blowing portion 29 that floats the upper portion of the sheet bundle on the tray to be loosened and separates the sheet S one by one, and a pair of drawing rollers 42. The air blowing portion 29 blows air toward the sheet S supported by the tray 12 to float the sheet.

The suction conveying portion 23 has a suction conveying belt 21 that rotates in a counter clockwise direction of FIG. 2 while being wound around a pair of belt driving rollers 41 and 41. The suction conveying belt 21 configures a suction conveying member that sends the sucked sheet S to the pair of drawing rollers 42 in the downstream of the sheet feeding direction (right direction in the drawing) with a conveyance force. The suction conveying portion 23 includes a suction fan 36 which generates a negative pressure in order to suck the sheet S to the suction conveying belt 21.

The suction conveying portion 23 is disposed inside a plurality of suction conveying belts 21 (between the belts) provided in a front-rear direction of FIG. 2. The suction conveying portion 23 has a long suction duct 34 in the front-rear direction of FIG. 2 so as to suck the air through a suction hole formed in the suction conveying belt 21, which is not illustrated. Further, the suction conveying portion 23 has a suction shutter 37 that is disposed in the suction duct 34 and switches on/off of the negative pressure generation in the suction duct 34 and switches on/off the sucking operation of the suction conveying belt 21. The suction shutter 37 adjusts a degree of the negative pressure applied to the suction duct 34. The suction duct 34 creates a negative pressure space that sucks the uppermost sheet by blowing air in a direction of an arrow F in FIG. 2 by the suction fan 36. The suction duct 34, the suction fan 36, and the suction shutter 37 configure a negative pressure generating portion having a suction opening 34*a* that applies a negative pressure for sheet suction to the suction conveying belt 21.

The air blowing portion 29 includes a blowing nozzle 33*a* that blows air from the leading edge to the upper portion of the sheet bundle, a separation nozzle 33*b*, a blowing fan 32, and a blowing and separating duct 33 that sends air from the blowing fan 32 to the nozzles 33*a* and 33*b*. The air sucked by the blowing fan 32 passes through the blowing and separating duct 33 to be blown in a direction of an arrow C (substantially horizontal direction) by the blowing nozzle 33*a* to float several sheets among upper sheets S loaded on the tray 12. Further, the air sucked by the blowing fan 32 is blown in a direction of an arrow D by the separation nozzle 33*b* and separates the uppermost sheet Sa among the sheets floated by the blowing nozzle 33*a* from the other sheets to be sucked on the suction conveying belt 21. The sucked sheet is sent to the pair of the drawing rollers 42 in the downstream of the conveying direction by the conveyance force of the suction conveying belt 21.

With this configuration, if the user pulls out the sheet storage case 11 to the front side of FIG. 2, sets the sheet S, and stores the sheet storage case 11 in a predetermined position, a lifter motor 19 (see FIG. 5) is driven so that the tray 12 starts to be lifted in a direction of an arrow A of FIG. 2. The tray 12 stops in a position where a distance from the suction conveying belt 21 becomes a distance B of the drawing to be ready for a feeding signal.

Figure 5:
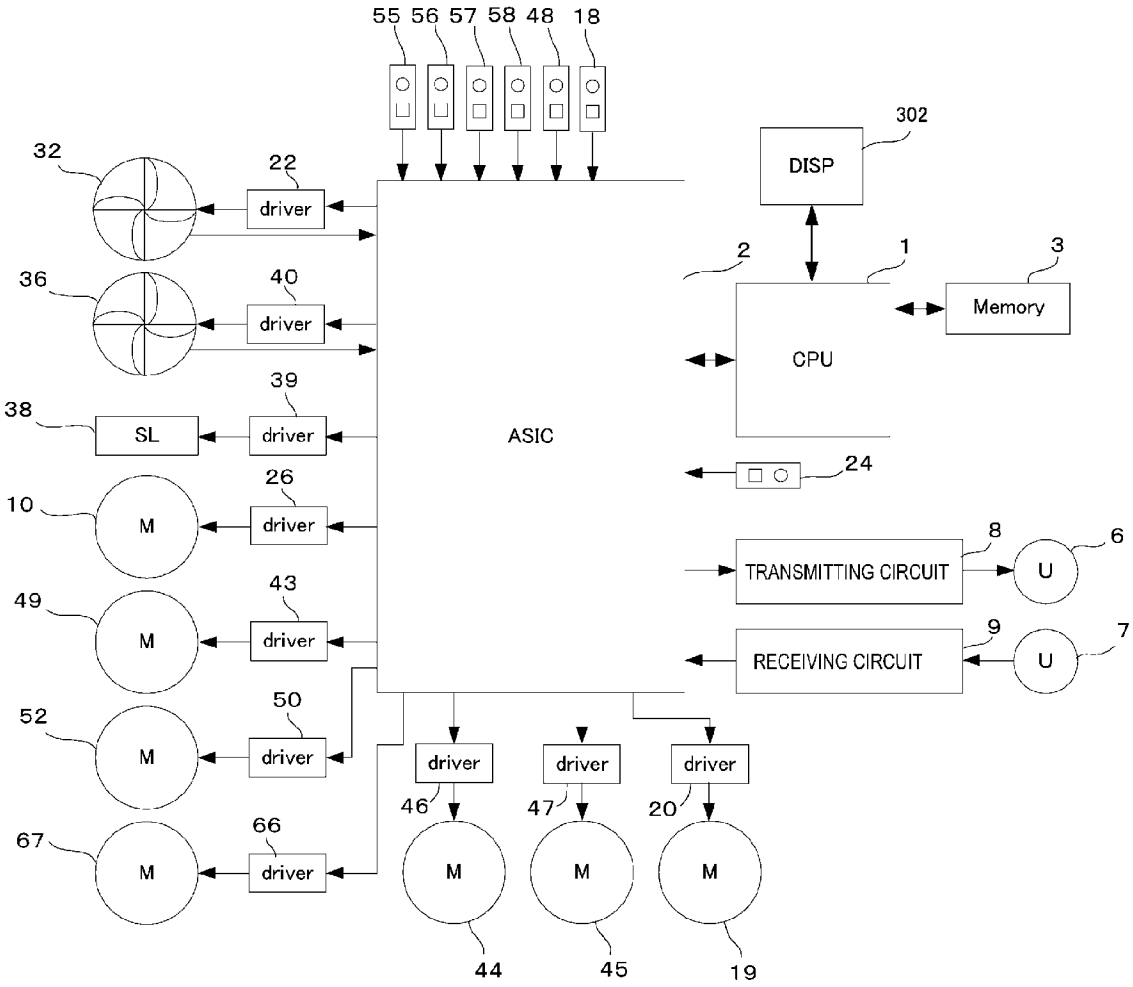
FIG. 5 is a block diagram illustrating a control system of the sheet feeding device according to the embodiment of the present invention.

Next, referring to FIG. 5, a circuit diagram in each of the feeding portions of the sheet feeding devices 311 and 312 of the sheet feeding unit 301 according to the embodiment will be described.

Specifically, the CPU 1 that controls the sheet feeding devices 311 and 312 is connected with an exclusive ASIC 2 that drives various loads of the sheet feeding device such as a motor or a fan and an operation portion 302 that is capable of inputting sheet information such as a size, a basis weight, and a surface property of the sheet. The operation portion 302 displays a state of the device which should be notified to a user on a screen. Further, the CPU 1 which is a controller is connected with a storage portion (memory) 3 that stores various data input by the operation portion 302 (see FIG. 1), a target value or a PWM value used to adjust a fan.

The ASIC 2 is connected to a lower position detecting sensor 55, a sheet presence detecting sensor 56, an upper position detecting sensor 57, a suction completion sensor 58, a storage case opening/closing sensor 48, a sheet surface detecting sensor 18, and a sheet detecting sensor 24.

The lower position detecting sensor 55 is a positional sensor of the tray 12 in the sheet storage case 11. The sheet presence detecting sensor 56 detects the presence of the sheet on the tray 12. The upper position detecting sensor 57 is a positional sensor of the tray 12 in the sheet storage case 11. The suction completion sensor 58 monitors a negative pressure state in the suction duct 34 when the sheet is sucked by the suction fan 36 of the suction conveying portion 23 and detects that the sheet suction is completed. The storage case opening/closing sensor 48 detects the open/close state of the sheet storage case 11. The sheet surface detecting sensor 18 detects a top surface of the sheet which is loaded on the tray 12. The sheet detecting sensor 24 detects the presence of the sheet in front of the transmission side and the reception side ultrasonic wave sensors 6 and 7 in the merged conveying portion 319 (see FIG. 1). A detecting portion of the present invention is configured by the transmission side and the reception side ultrasonic wave sensors 6 and 7.

The ASIC 2 monitors an output of the various sensors connected thereto. Further, the ASIC 2 not only issues a driving start command to a driving circuit that drives loads of the sheet feeding unit 301 but also receives a rotational number signal (FG) of the blowing fan 32 and the suction fan 36 to control the PWM so as to rotate the fan a target rotational number of times.

The ASIC 2 is connected to a blowing fan driving circuit 22, a suction fan driving circuit 40, a driving circuit 39, a driving circuit 26, a driving circuit 43, a driving circuit 50, a driving circuit 66, a driving circuit 46, a driving circuit 47, and a driving circuit 20.

The blowing fan driving circuit 22 transmits a PWM signal output from the ASIC 2 to the blowing fan 32 and supplies power. The suction fan driving circuit 40 transmits the PWM signal output from the ASIC 2 to the suction fan 36 and supplies power. The driving circuit 39 drives a suction solenoid 38 so as to open/close the suction shutter 37 in the suction duct 34 of the suction conveying portion 23. The driving circuit 26 drives a lower conveying motor 10 that rotates a conveying roller of the lower conveying portion 318.

The driving circuit 43 drives an upper conveying motor 49 that rotates the conveying roller of the upper conveying portion 317. The driving circuit 50 drives a merged conveying motor 52 that rotates the conveying roller of the merged conveying portion 319. The driving circuit 66 drives an escape conveying motor 67 that rotates the conveying roller of the escape conveying path 333.

The driving circuit 46 drives a sheet feeding motor 44 that rotates a belt driving roller 41 of the suction conveying portion 23. The driving circuit 47 drives a drawing motor 45 that rotates the pair of drawing rollers 42. The driving circuit 20 drives the lifter motor 19 which is a lifter driving unit that lifts and lowers the tray 12.

The ASIC 2 is connected with a transmitting circuit 8 and a receiving circuit 9. The transmitting circuit 8 generates a transmitting signal and transmits the signal to the transmission side ultrasonic wave sensor 6 in accordance with the command of the ASIC 2. The receiving circuit 9 receives a receiving signal from the reception side ultrasonic wave sensor 7 to transmit the signal to the ASIC 2.

In the sheet feeding unit 301 according to the embodiment, various loads of the sheet feeding unit 301 such as a motor, a fan, or a sensor are controlled via the exclusive ASIC 2 from the CPU 1. However, the sheet feeding unit 301 may be configured such that the various loads may be directly controlled by the CPU 1. Further, in the sheet feeding unit 301, the operation portion 302 and the storage portion 3 are directly connected to the CPU 1 to be included in the sheet feeding unit 301. However, the sheet feeding unit 301 is not limited to the current configuration, and may be configured such that the loads are controlled using the operation portion 302 and the storage portion 3 included in the image forming apparatus 300A having the sheet feeding unit 301. However, not only sheet information input from the operation portion 302 but also sheet information which is automatically recognized by a sheet information detecting portion (not illustrated) disposed in the sheet feeding unit 301 may be used.

Next, referring to FIGS. 3A to 3C and FIGS. 4A and 4B, an overlay feeding operation will be described. FIGS. 3A to 3C and FIGS. 4A and 4B illustrate a method of overlaying a preceding uppermost sheet Sa and a subsequent sheet Sb in the feeding portion of the sheet feeding unit 301.

Figure 3A:
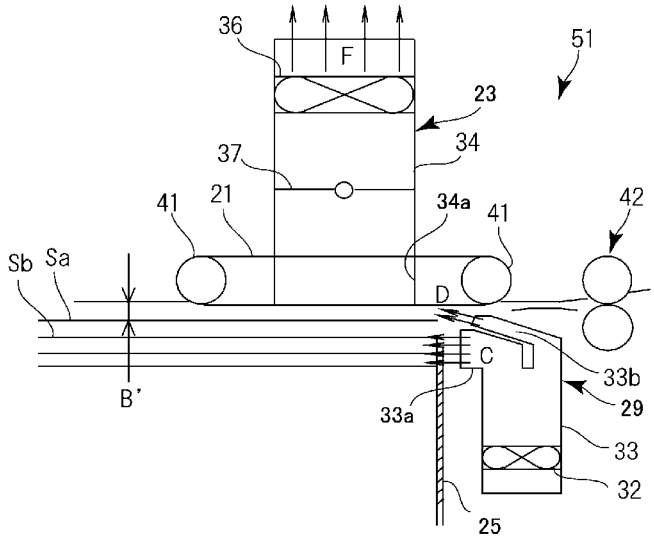
FIGS. 3A to 3C are cross-sectional views illustrating a feeding operation by a suction conveying mechanism of the sheet feeding device according to the embodiment of the present invention.

First, at a time when being ready for a feeding signal in a stopping state in a position where a distance between the uppermost sheet Sa and the suction conveying belt 21 is B, the sheet feeding unit 301 receives a feeding signal. In this case, as illustrated in FIG. 3A, the suction fan 36 of the suction conveying portion 23 is driven to blow air in a direction of an arrow F in the drawing. Similarly, the blowing fan 32 is driven to blow blowing air in a direction of an arrow C in the drawing and separation air in a direction of an arrow D to start the blowing of air.

Figure 3B:
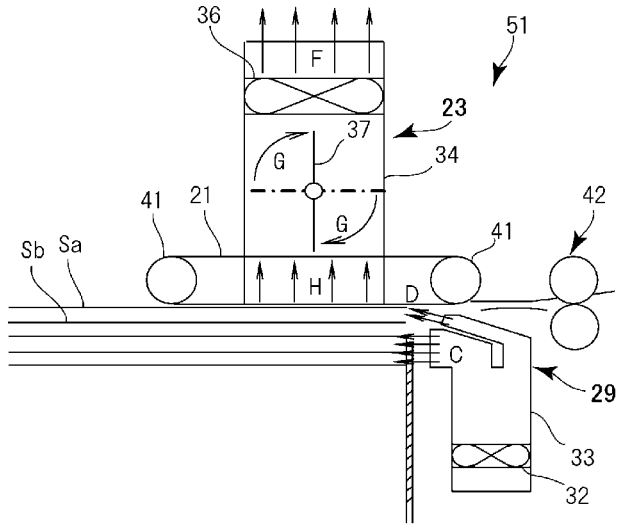
Figure 3C:
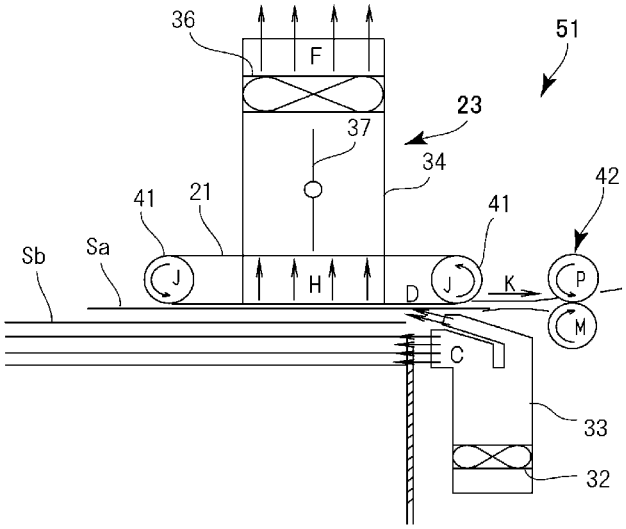

If it is detected that the distance between the sheet surface position of the uppermost sheet Sa and the suction conveying belt 21 is B' by air blowing, the driving circuit 39 drives the suction solenoid 38. By doing this, as illustrated in FIG. 3B, the suction shutter 37 in the suction duct 34 of the suction conveying portion 23 is opened to suck the uppermost sheet Sa onto the suction conveying belt 21 by the suction air in a direction of an arrow H in the drawing. As illustrated in FIG. 3C, the uppermost sheet Sa sucked onto the suction conveying belt 21 is conveyed to the downstream by the conveyance force of the suction conveying belt 21.

Figure 4A:
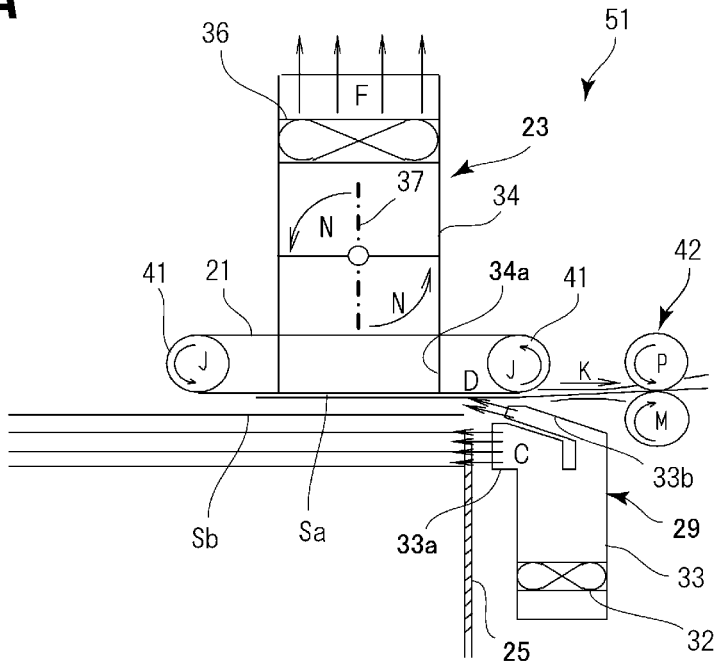
FIGS. 4A and 4B are cross-sectional views illustrating a feeding operation by a suction conveying mechanism of the sheet feeding device according to the embodiment of the present invention.

Continuously, as illustrated in FIG. 4A, at a predetermined time after conveying the uppermost sheet Sa, the suction solenoid 38 is driven by the driving circuit 39 to close the suction shutter 37 in the suction duct 34 of the suction conveying portion 23 and prevent the subsequent sheet Sb from being sucked and conveyed.

Figure 4B:
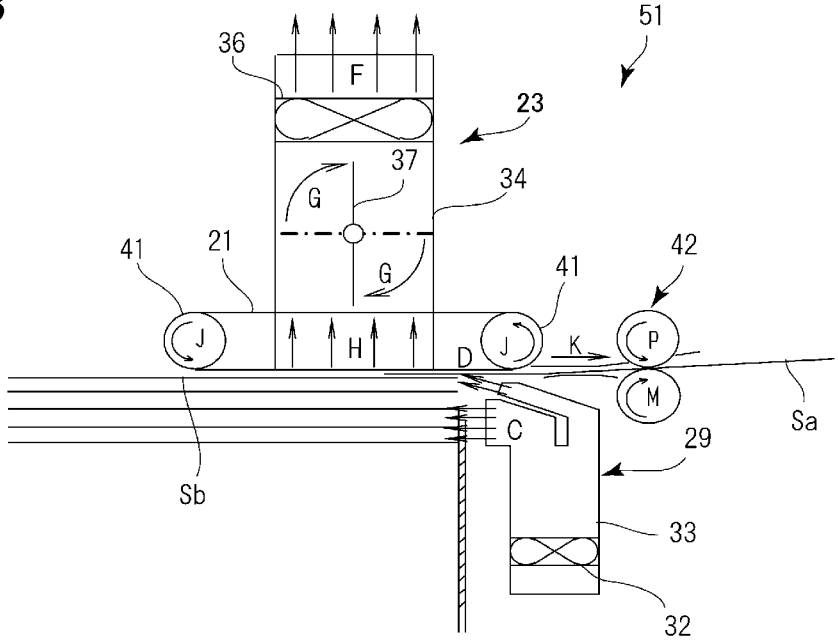

As illustrated in FIG. 4B, in a state when a trailing edge of the preceding uppermost sheet Sa remains in the sheet bundle, at a timing when an overlaid amount of the uppermost sheet Sa and the subsequent sheet Sb is a predetermined amount, the suction shutter 37 is opened by driving the suction solenoid 38. By doing this, the subsequent sheet Sb may be sucked onto the suction conveying belt 21 by the suction air in a direction of an arrow H in the drawing. Accordingly, in a state where the upstream edge of the feeding direction of the uppermost sheet Sa which is a preceding sheet is overlaid with the downstream edge of the feeding direction of the next sheet Sb which is a subsequent sheet, the sheet Sb may be conveyed (fed) to the downstream by the conveyance force of the suction conveying belt 21.

Continuously, referring to FIG. 6, a specific arrangement of the transmission side ultrasonic wave sensor 6 and the reception side ultrasonic wave sensor 7 as detecting portions will be described.

Figure 6:
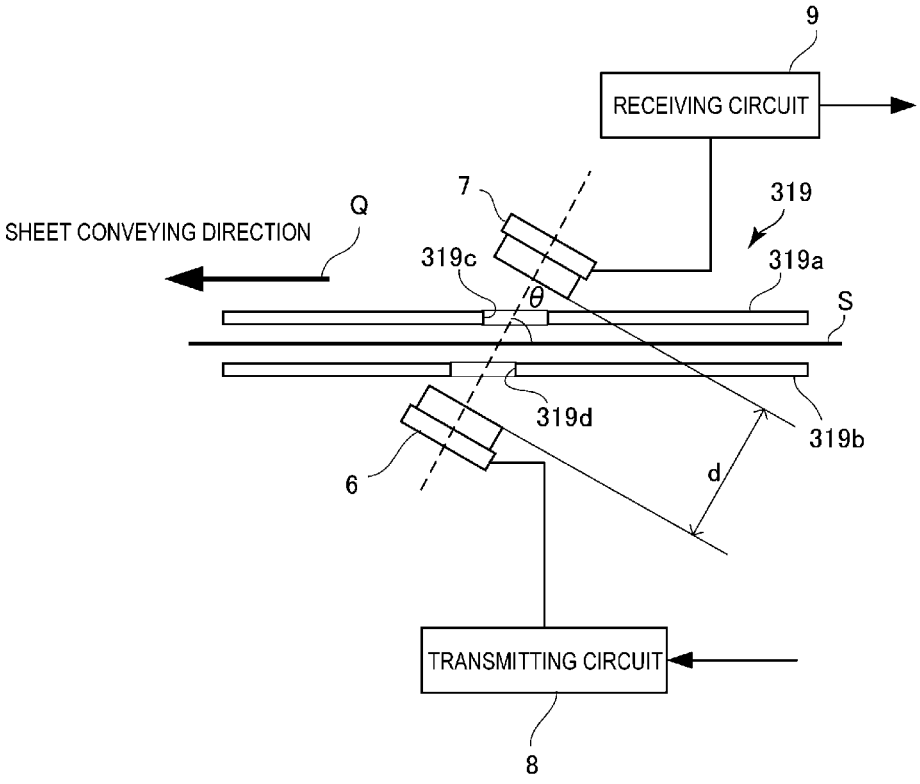
FIG. 6 is a schematic view illustrating a specific arrangement of a double feed detecting sensor of a sheet feeding device according to a first embodiment of the present invention.

As illustrated in FIG. 6, in the merged conveying portion 319, an upper conveying guide 319*a* and a lower conveying guide 319*b* are disposed with a predetermined interval therebetween so as to be parallel to each other. An opening 319*c* is formed in the upper conveying guide 319*a* and an opening 319*d* is formed in the lower conveying guide 319*b*. These openings 319*c* and 319*d* are formed so as to correspond to arrangement angles of the ultrasonic wave sensors 6 and 7 which will be described below.

The transmission side ultrasonic wave sensor 6 that transmits an ultrasonic wave is disposed at a lower side and the reception side ultrasonic wave sensor 7 that receives the ultrasonic wave transmitted from the transmission side ultrasonic wave sensor 6 is disposed at an upper side so as to be separated with a distance d (a predetermined distance) therebetween and obliquely opposite to each other while the merged conveying portion 319 is interposed therebetween. The pair of ultrasonic wave sensors 6 and 7 as the detecting portion is disposed so as to be opposite to each other and oblique in a sheet feeding direction while the sheet to be fed is interposed therebetween and the sensors 6 and 7 are separated with a predetermined distance. The obliquely opposing arrangement allows the transmittance axis between the ultrasonic wave sensor 6 and the ultrasonic wave sensor 7 to form an angle θ with a sheet S which passes through the merged conveying portion 319 in a direction of an arrow Q in order to avoid the influence of the multiple reflection of the ultrasonic wave transmitted from the transmission side ultrasonic wave sensor 6.

Figure 7:
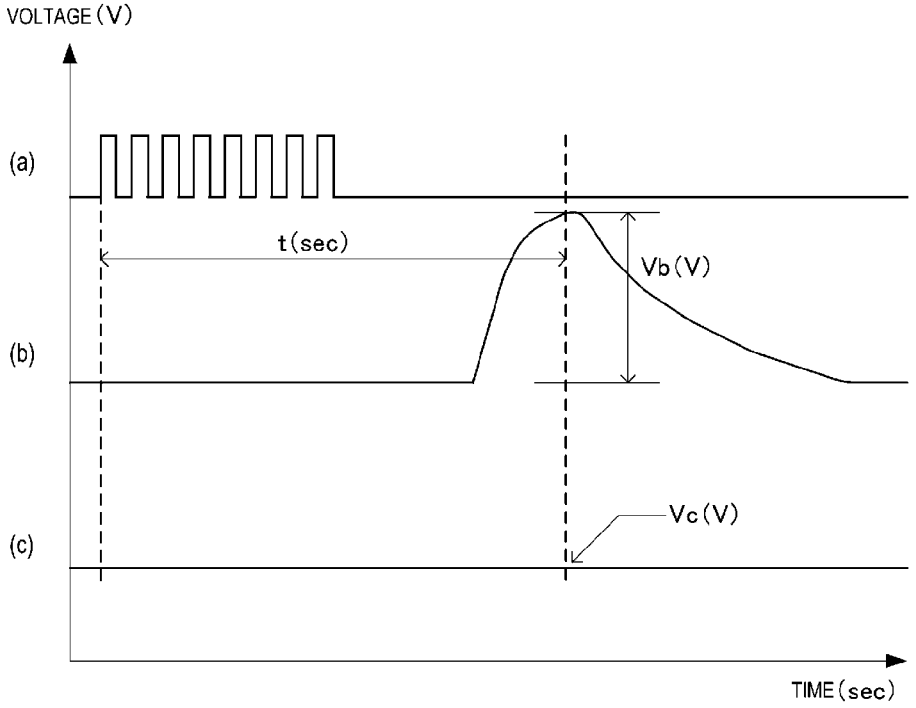
FIG. 7 is an explanatory view of a signal of the double feed detecting sensor of the sheet feeding device according to the first embodiment of the present invention.

Next, referring to FIG. 7, input/output signals to the transmitting circuit 8 and the receiving circuit 9 which may correspond to the transmission side ultrasonic wave sensor 6 and the reception side ultrasonic wave sensor 7 will be described.

In other words, in FIG. 7A, a burst wave having a predetermined frequency is input to the transmitting circuit 8 as an input signal having a predetermined pulse number (8 pulses in this drawing). FIG. 7B illustrates an output signal of the receiving circuit 9 when one sheet is detected at a point of a sheet whose overlaid state is detected by receiving the ultrasonic wave transmitted from the transmission side ultrasonic wave sensor 6 by the reception side ultrasonic wave sensor 7. FIG. 7C illustrates an output signal of the receiving circuit 9 when two sheets are overlaid at the point of a sheet whose overlaid state is detected.

A voltage of an output signal of the receiving circuit 9 after a predetermined time t (sec) when the pulse is input to the transmitting circuit 8 is Vb (V) when one sheet is detected as illustrated in FIG. 7B. In contrast, when two sheets are overlaid as illustrated in FIG. 7C, the voltage is Vc (V) which is almost 0 (V). Here, it is possible to easily discriminate whether the sheet is one or two sheets are overlaid by using a threshold value between the voltages Vc and Vb.

Next, referring to FIG. 8, a method of determining an overlaid amount of sheets in the sheet feeding unit 301 to which this invention is applied will be described.

Figure 8A:
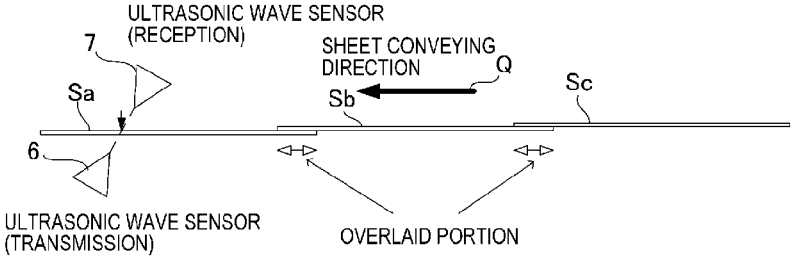
FIGS. 8A to 8D are explanatory views of sheet overlaying determination of the sheet feeding device according to the first embodiment of the present invention.

That is, FIG. 8A illustrates a state where the transmission side ultrasonic wave sensor 6 and the reception side ultrasonic wave sensor 7 are disposed to be opposite to each other with the sheets, which are conveyed while the trailing edge of the preceding sheet Sa and the leading edge of the subsequent sheet Sb are overlaid in the sheet conveying direction, interposed therebetween. This drawing illustrates a state where sheets are conveyed while the trailing edge of the subsequent sheet Sb and the leading edge of a next subsequent sheet Sc are overlaid.

Figure 8B:
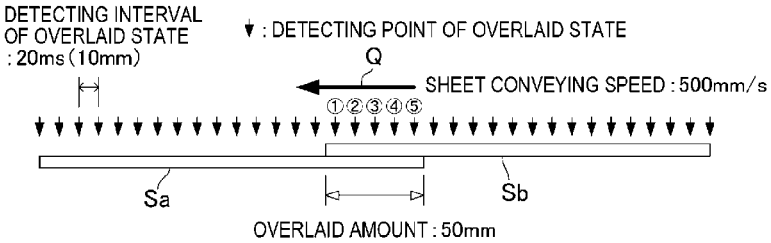

In FIG. 8B, the sheets Sa, Sb, and Sc are conveyed in an overlaid state at a conveying speed of 500 mm/s with an overlaid amount of 50 mm. If the overlaid state of the sheets is detected at an interval of 20 ms, which is a desired overlaid amount, the number of points (detecting points) where two sheets are detected is five (here, if the detection is performed from the sheet edge, maximum six points may be detected).

Figure 8C:
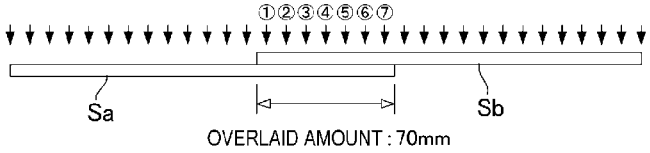

FIG. 8C illustrates that if the overlaid amount is 70 mm which is larger than a desired overlaid amount, the number of points (detecting points) where two sheets are detected is seven (here, if the detection is performed from the sheet edge, maximum eight points may be detected). In this case, the overlaid amount is larger than a desired amount so that a possibility that the sheets are separated between the sheet feeding unit 301 and the main body 300 is high. Therefore, it is determined as double feeding.

Figure 8D:
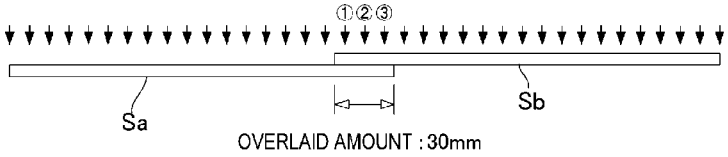

FIG. 8D illustrates that if the overlaid amount is 30 mm which is smaller than a desired overlaid amount, the number of points (detecting points) where two sheets are detected is three (here, if the detection is performed from the sheet edge, maximum four points may be detected). In this case, the overlaid amount is smaller than a desired amount so that when the sheets are separated between the sheet feeding unit 301 and the main body 300, the interval between sheets are too large. Therefore, a possibility of causing the delay in transferring the toner image onto the sheet in the main body 300 is high. Therefore, it is determined as a delay jam (delay overlaid state).

Specifically, the CPU 1 serving as a controller continuously detects the overlaid state for sheets fed from the feeding portions 51, 317 to 319 at a predetermined number of detecting points along the sheet feeding direction at every predetermined time. Therefore, the number of detecting points where the overlaid state is detected is determined. Based on the determined number of the detecting points, if the number of detecting points is within a predetermined range in which the number is equal to or larger than a first number and the number is equal to or smaller than a second number that is larger than the first number, it is determined that the overlaid state is normal. In contrast, if the number of detecting points is out of the predetermined range, it is determined that the overlaid state is abnormal. If the number of detecting points exceeds the predetermined range, the CPU 1 determines as a double feeding state where the overlaid amount in the overlaid state is excessive. In contrast, if the number of detecting points is smaller than the predetermined range, the CPU 1 determines as a delay overlaid state where the overlaid amount is too small.

Figure 9:
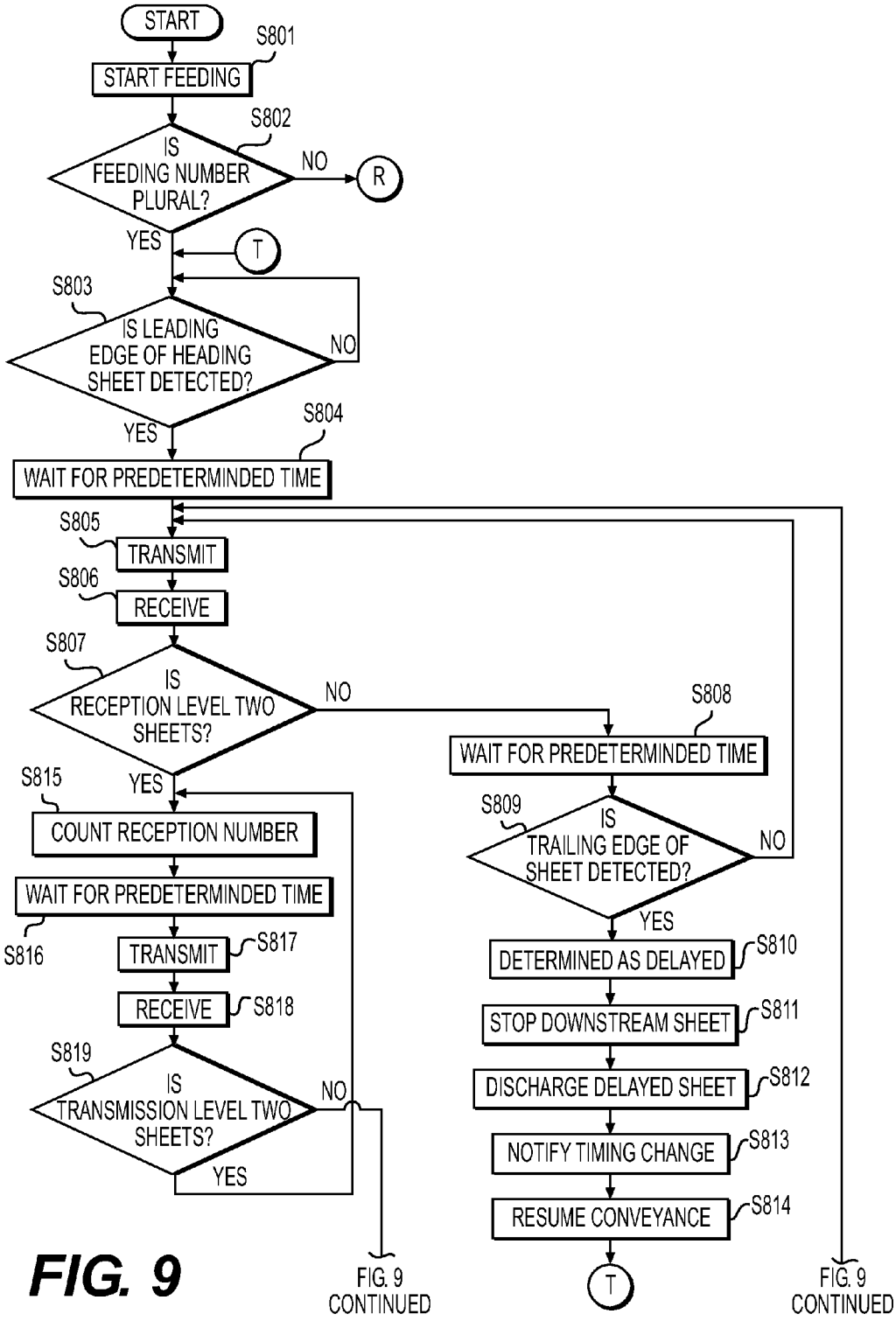
FIG. 9 is a flowchart illustrating an operation of the sheet feeding device according to the first embodiment of the present invention.
Figure 9:
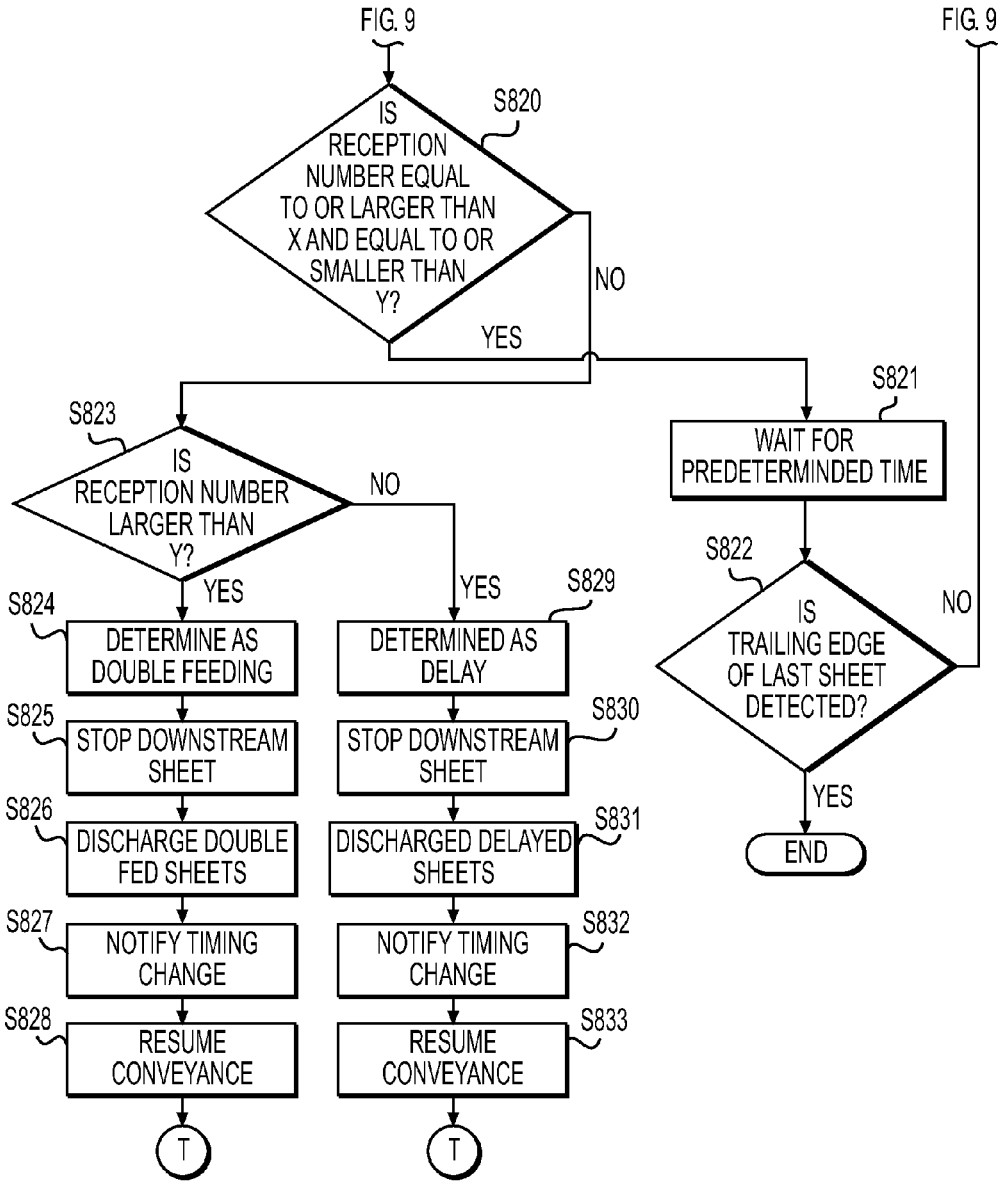
Figure 10:
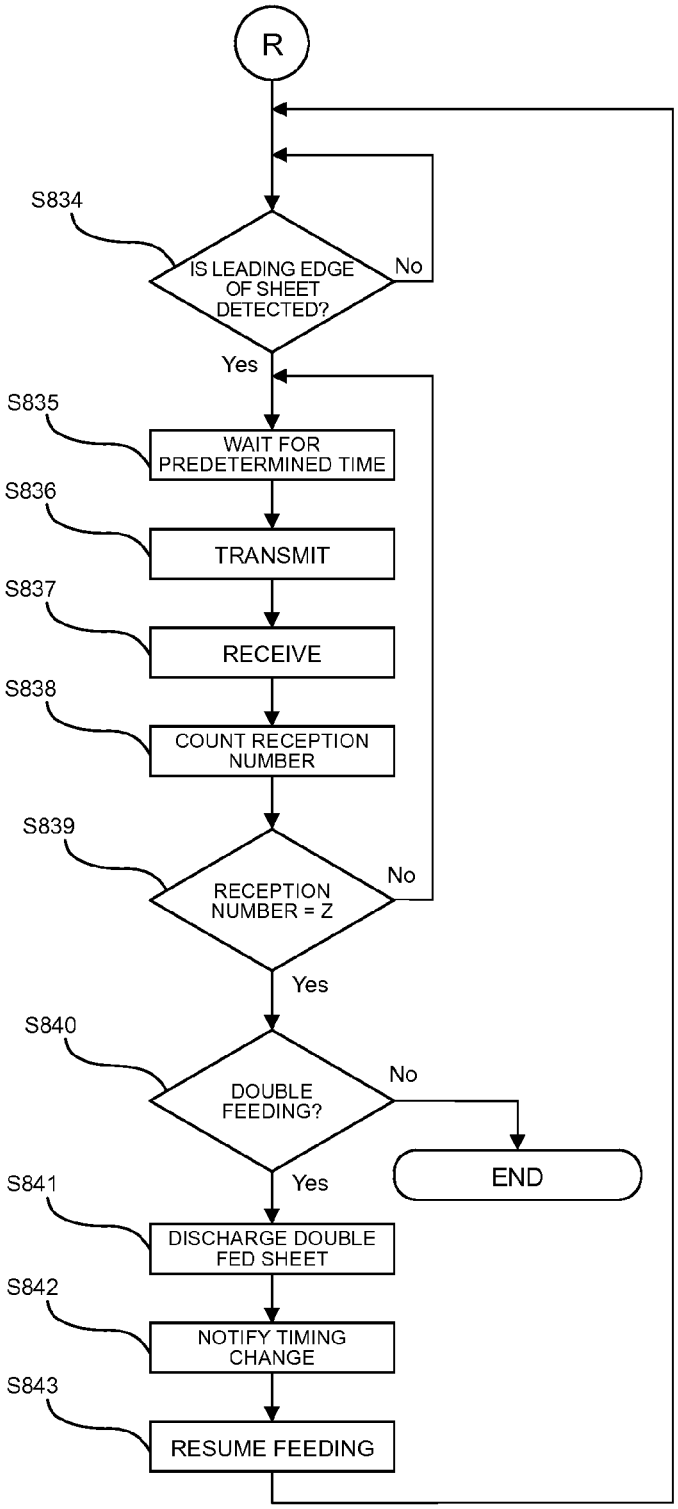
FIG. 10 is a flowchart illustrating an operation of sheet feeding device according to the first embodiment of the present invention.

Referring to flowcharts of FIGS. 9 and 10, an operation by the CPU 1 serving as a controller of the sheet feeding unit 301 according to the embodiment will be described. The sequence starts from a state where the sheet feeding unit 301 receives a feeding signal.

First, the CPU 1 starts the sheet feeding from the sheet storage case 11 in accordance with the feeding signal (S801). In step S802, it is determined whether the number of fed sheets is plural. If the number of fed sheets is one, the sequence proceeds to step S834 to perform a double feeding detection processing for single sheet feeding. If the number of fed sheets is plural, the sequence proceeds to step S803.

In step S803, a leading edge of a heading sheet which is fed in an overlaid state is monitored by the sheet detecting sensor 24 to wait for a predetermined time at a time when the leading edge is detected (S804). Thereafter, the transmission side ultrasonic wave sensor 6 and the reception side ultrasonic wave sensor 7, which are disposed to be opposite to each other with the sheet interposed therebetween, transmit (S805) and receive (S806) a signal, respectively.

In step S807, based on a reception level by the reception side ultrasonic wave sensor 7, it is determined whether the overlaid state is a two sheet overlaid state. As a result, if the reception level is not a level in the two sheet overlaid state, the sequence proceeds to S808 to wait for a predetermined time. Thereafter, it is monitored until the sheet detecting sensor 24 detects a trailing edge of the sheet which is conveyed in an overlaid state (S809).

In step S809, when the trailing edge of the sheet is detected, it is determined that the sheets are not overlaid and the subsequent sheet is delayed by detecting the trailing edge of the sheet without detecting a level where two sheets are overlaid (S810). Then, conveyance of sheets in the downstream of the subsequent sheet which is delayed is stopped, the sheets are separated from the delayed subsequent sheet (S811), and the switching member 310 switches the sheet conveying path into the escape conveying path 333 to discharge the delayed sheet to the escape tray 101 (S812).

Continuously, it is notified to the main body 300 that the delayed sheet is discharged, which changes the timing when a next sheet is conveyed (S813) and the stopped conveyance of the downstream sheet is resumed (S814). The sequence returns to S803 from T. Specifically, if it is determined as the delay overlaid state, the CPU 1 notifies delay information of the delayed sheet to the main body 300 that receives the sheet fed from the feeding portion at a downstream side of the sheet feeding direction and then delivers the sheet to the main body 300 while continuously performing a predetermined feeding operation by the feeding portion.

In the meantime, in step S807, if the reception level is a level in a two sheet overlaid state, in step S815, the level in the two sheet overlaid state is counted. Continuously, after waiting for a predetermined time in step S816, the transmission by the transmission side ultrasonic wave sensor 6 is performed again in step S817 and the reception by the reception side ultrasonic wave sensor 7 is performed in step S818.

In step S819, it is determined whether the reception level is a level in the two sheet overlaid state. If the reception level is a level in the two sheet overlaid state, the sequence returns to step S815 and the level in the two sheet overlaid state is counted again.

In contrast, in step S819, if the reception level is not a level in the two sheet overlaid state, it is determined that the overlaid portion of the sheet is excluded and the sequence proceeds to step S820. In step S820, a state of a sheet which is conveyed in an overlaid state is determined from a value obtained by counting number of times of reception of a level in the two sheet overlaid state.

Specifically, in step S820, it is determined whether the reception number of a level in the two sheet overlaid state is equal to or larger than a predetermined value X and equal to or smaller than a predetermined value Y (≥X). If the reception number is within the range, the amount indicates a desired overlaid amount, which means that the sheet is normal. Therefore, the sequence proceeds to step S821. In step S821, after waiting for a predetermined time, if a trailing edge of a last sheet of sheets conveyed in an overlaid state is not detected in step S822, the sequence returns to step S805 to monitor a state of a next overlaid portion. In the meantime, in step S822, if the trailing edge of the last sheet is detected, after the last sheet is delivered to the main body 300, the feeding operation in this job is completed.

A sheet is conveyed with an overlaid amount 50 mm of the preceding sheet and the subsequent sheet under the condition illustrated in FIG. 8B, that is, the sheet conveyance speed of 500 mm/s and an interval 20 ms (10 mm) when the overlaid state of the sheets is detected. In this case, if an overlaid amount is a predetermined overlaid amount 50 mm, points where it is detected that the sheets are two are 5 to 6. Therefore, the predetermined value X is 5 and Y is 6. If the overlaid amount of the sheet is changed from 50 mm under the same condition as the above, it should be noted that the overlaid amount of the sheet does not become smaller than an interval where the overlaid state of the sheets is detected.

In step S820, if the reception number of a level in the two sheet overlaid state is not equal to or larger than a predetermined value X and not equal to or smaller than a predetermined value Y (≥X), in step S823, it is determined whether reception number of a level in the two sheet overlaid state is larger than the predetermined value Y. As a result, if the reception number is larger than the predetermined value Y, the sequence proceeds to step S824 and it is determined that the amount is larger than a desired overlaid amount so that it is double feeding.

The conveyance of sheets in the downstream of the double fed sheets is stopped and the sheets are separated from the double fed sheets (S825) and the switching member 310 switches the sheet conveying pass into the escape conveying path 333 and discharges the double fed sheets to the escape tray 101 (S826). Continuously, the double fed sheets are discharged to notify the main body 300 that the timing when a next sheet is conveyed is changed (S827). The stopped conveyance of the downstream sheet is resumed (S828) and the sequence returns to step S803 from T.

In the meantime, in step S823, if the reception number of a level in the two sheet overlaid state is not larger than the predetermined value Y, which means that the reception number is smaller than the predetermined value X. Therefore, the sequence proceeds to step S829. In step S829, it is determined that the amount is smaller than a predetermined overlaid amount so that the subsequent sheet is delayed. The conveyance of the sheet in the downstream of the delayed subsequent sheet is stopped and the sheet is separated from the delayed subsequent sheet (S830) and the switching member 310 switches the sheet conveying pass into the escape conveying path 333 and discharges the delayed sheet to the escape tray 101 (S831). Continuously, the delayed sheet is discharged to notify the main body 300 that the timing when a next sheet is conveyed is changed (S832). The stopped conveyance of the downstream sheet is resumed (S833) and the sequence returns to step S803 from T.

Next, a double feeding detection processing at the time of feeding one sheet from step S834 when the sequence proceeds from steps S802 to R will be described.

First, in step S834, the sheet detecting sensor 24 monitors the leading edge of the sheet to detect the leading edge and wait for a predetermined time (S835). After waiting for a predetermined time, the transmission by the transmission side ultrasonic wave sensor 6 is performed in step S836 and the reception by the reception side ultrasonic wave sensor 7 is performed in step S837. In step S838, it is counted that the sheet is in a level in the two sheet overlaid state.

Next, in step S839, it is determined whether the received number reaches a value Z which is previously set. As a result, if the number does not reach the value Z, the sequence returns to step S835 and the transmission of the transmission side ultrasonic wave sensor 6 and the reception of the reception side ultrasonic wave sensor 7 are repeated. If the received number reaches the preset value Z in step S839, the sequence proceeds to step S840.

Next, in step S840, it is determined whether the sheet is double fed from the received data obtained Z times. If it is determined that the sheet is double fed, the sequence proceeds to step S841 to switch the sheet conveying path into the escape conveying path 333 and discharge the double fed sheet to the escape tray 101.

Continuously, the double fed sheet is discharged to notify the main body 300 that the timing when a next sheet is delivered is changed (S842). The stopped conveyance of the downstream sheet is resumed (S843) and the sequence returns to step S834. In step S840, if it is determined that the sheet is not double fed, after delivering the sheet to the main body 300, the feeding operation is completed.

In the embodiment, if it is determined that the sheet is delayed, the delayed sheet is discharged to the escape tray 101. However, if the timing is corrected by notifying the delayed amount of the delayed sheet to the main body 300, there is no need to stop the conveyed sheet at the time of determination of delay and no need to discharge the delayed sheet from the escape tray 101.

Further, when depending on a size and a kind of the sheet, the overlaid amount of the preceding sheet and the subsequent sheet is changed, the values of X and Y where the reception number of the level where two sheets are overlaid is normal are correspondingly changed. Specifically, when the overlaid amount of the trailing edge of the preceding sheet and the leading edge of the subsequent sheet is changed, the CPU 1 serving as a controller changes the number of detecting points in the above-mentioned range to determine the overlaid amount.

In the above-described embodiment, based on the double feeding detecting result obtained by continuously operating the ultrasonic wave sensors 6 and 7, if the overlaid portion of the sheets is a predetermined width, it is determined that there is no problem. In contrast, if the overlaid portion is larger than the predetermined width, it is determined that it is double feeding and if the overlaid portion is smaller than the predetermined width, it is determined that the delay jam occurs. Therefore, if an intentionally overlaid portion is an appropriate width, it is not erroneously detected to be double feeding. If the overlaid portion is not an appropriate width, it is processed as double feeding or delay jam so that it is possible to stably convey the sheet from the feeding portion in an overlaid state.

Second Embodiment

Next, a second embodiment of the present invention will be described with reference to FIGS. 11 and 12 which are flowcharts of operations by the control of the CPU 1. An image forming apparatus 300A (image forming system) according to the second embodiment has the same configuration as illustrated in FIG. 1 of the first embodiment. Therefore, description thereof will be omitted. Further, outlines of sheet feeding devices 311 and 312 and a circuit diagram of feeding portions of the sheet feeding devices 311 and 312 in the embodiment are the same as those of FIGS. 2 to 5 of the first embodiment and thus the description thereof will be omitted.

In the embodiment, if it is determined that the sheet is double fed, the feeding of the sheet feeding unit 301 is stopped and the occurrence of the double feeding is displayed on the operation portion 302 until the sheet on the sheet conveying path is removed. Similarly, if it is determined that the sheet is delayed, the feeding of the sheet feeding unit 301 is stopped and the occurrence of the delay jam (delay overlaid state) is displayed on the operation portion 302 until the sheet on the sheet conveying path is removed. In any case, after removing the sheet, the display on the operation portion 302 serving as a display is cleared and the feeding operation is resumed.

In the embodiment, if it is determined that the overlaid state of the sheet is normal, the CPU 1 serving as a controller continues the feeding operation of the feeding portion as described above. If it is determined that the overlaid state is abnormal, the feeding to the downstream of the feeding portion is stopped and an acknowledgement that it is determined that the overlaid state is abnormal is displayed on the operation portion 302.

Figure 11:
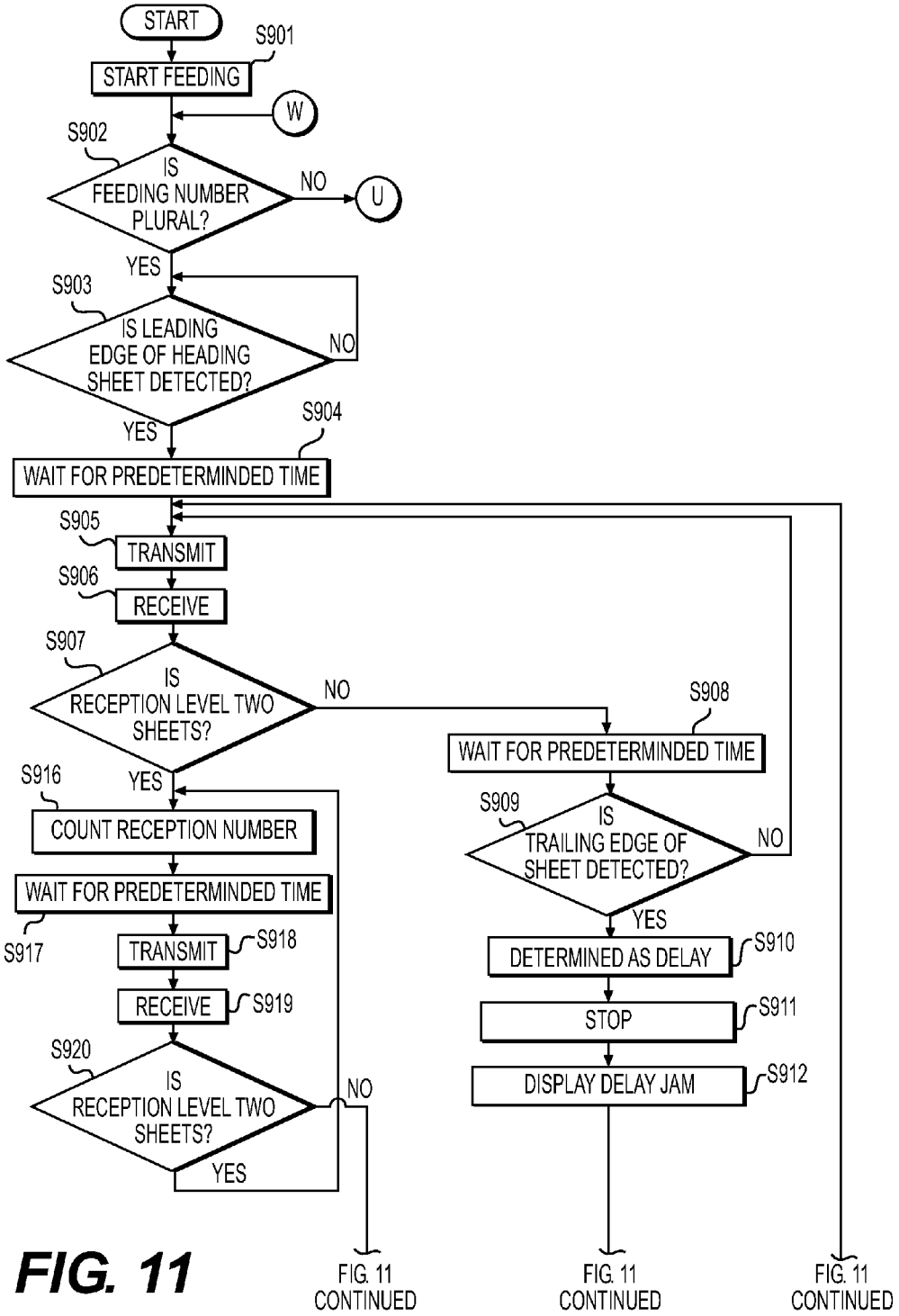
FIG. 11 is a flowchart illustrating an operation of a sheet feeding device according to a second embodiment of the present invention.
Figure 11:
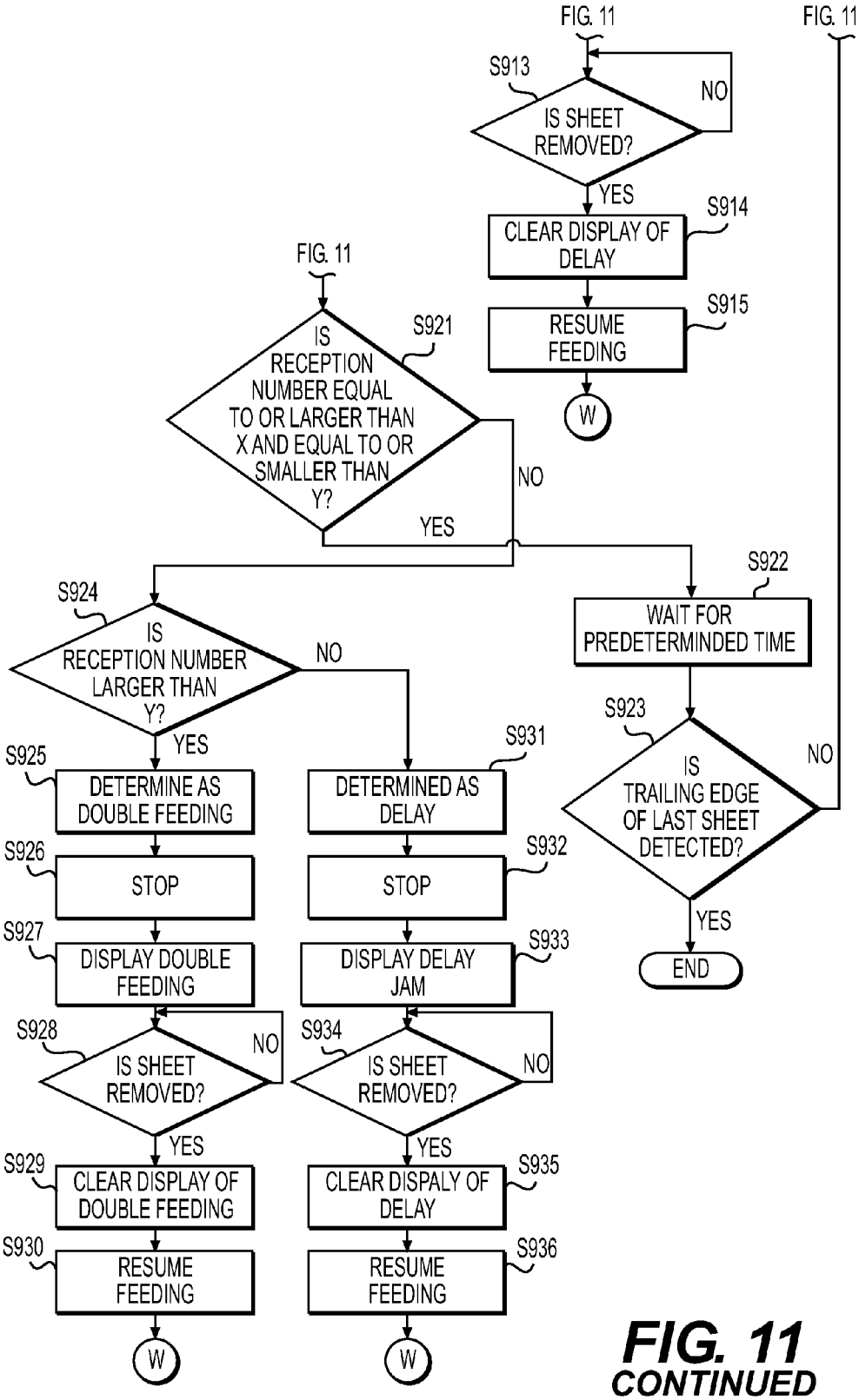
Figure 12:
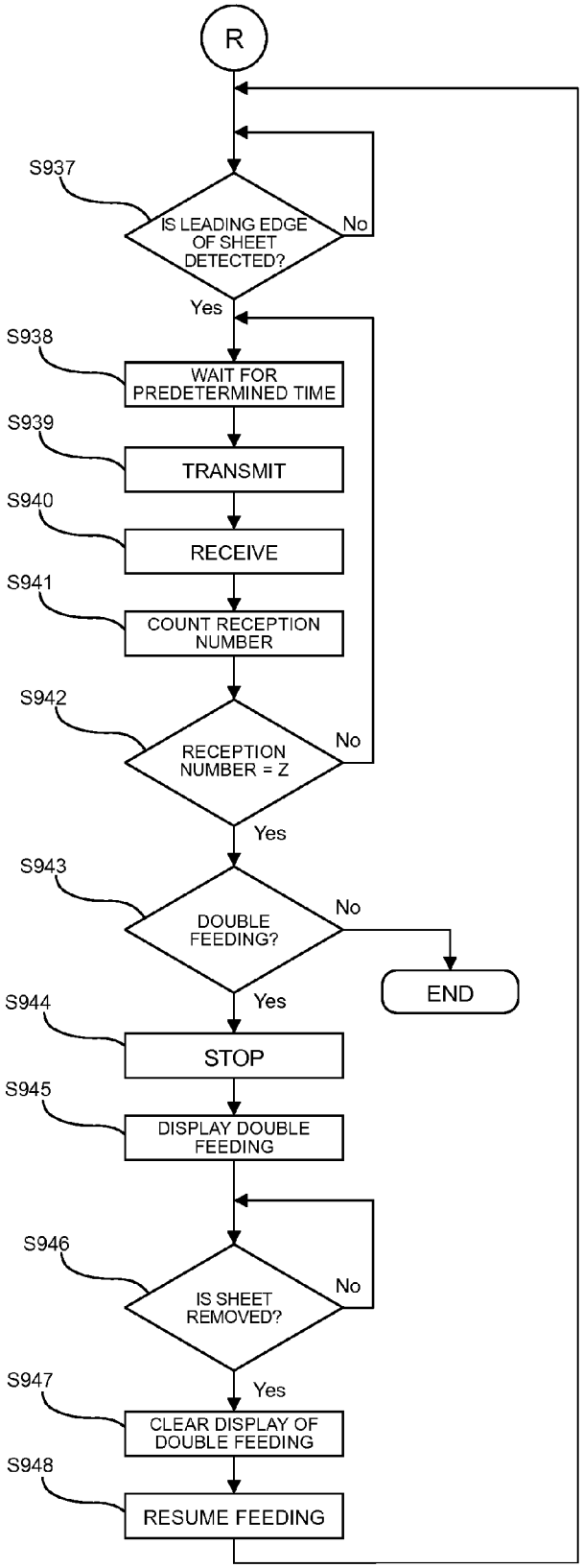
FIG. 12 is a flowchart illustrating an operation of sheet feeding device according to the second embodiment of the present invention.

In the flowcharts of FIGS. 11 and 12, the sequence starts from a state where the sheet feeding unit 301 receives a feeding signal. First, the CPU 1 starts feeding from the sheet storage case 11 in accordance with the feeding signal (S901). Continuously, in step S902, if the number of fed sheets is determined as one, the sequence proceeds to step S937 from U to perform a double feed detection processing for single sheet feeding. In step S902, if the number of fed sheets is plural, the sequence proceeds to step S903.

In step S903, a leading edge of a heading sheet which is fed in an overlaid state is monitored by the sheet detecting sensor 24 and the leading edge is detected to wait for a predetermined time (S904). Thereafter, the transmission is performed by the transmission side ultrasonic wave sensor 6 in step S905 and the reception is performed by the reception side ultrasonic wave sensor 7 in step S906. Continuously, in step S907, based on a reception level by the reception side ultrasonic wave sensor 7, it is determined whether the overlaid state is in a level in a two sheet overlaid state.

In step S907, if the reception level is not a level in the two sheet overlaid state, the sequence proceeds to S908 to wait for a predetermined time. Thereafter, it is monitored until the sheet detecting sensor 24 detects a trailing edge of the sheet which is conveyed in an overlaid state (S909). In step S909, when the trailing edge of the sheet is detected, it is determined that the sheets are not overlaid and the subsequent sheet is delayed by detecting the trailing edge of the sheet without detecting a level in the two sheet overlaid state (S910).

In step S911, the sheet conveyance is stopped and the occurrence of the delay jam is displayed on the operation portion 302 (S912). Continuously, in step S913, it is monitored until the sheet on the sheet conveying path is removed. If it is determined that the removal is detected, the display of the delay jam on the operation portion 302 is cleared in step S914 and the feeding operation is resumed in step S915 and the sequence returns to step S902 from W.

In the meantime, in step S907, if the reception level is a level in the two sheet overlaid state, in step S916, it is counted that the reception level is a level in the two sheet overlaid state. Continuously, after waiting for a predetermined time in step S917, the transmission is performed by the transmission side ultrasonic wave sensor 6 again in step S918 and the reception is performed by the reception side ultrasonic wave sensor 7 in step S919.

Continuously, in step S920, it is determined whether the reception level is a level in the two sheet overlaid state. If the reception level is a level in the two sheet overlaid state, the sequence returns to step S916 and it is counted again that the reception level is a level in the two sheet overlaid state in step S916.

In contrast, in step S920, if the reception level is not a level in the two sheet overlaid state, it is determined that the overlaid portion of the sheet is excluded. Continuously, in step S921, a state of a sheet which is conveyed in an overlaid state is determined based on the counted reception number of a level in the two sheet overlaid state.

In step S921, it is determined whether the reception number of a level in the two sheet overlaid state is equal to or larger than a predetermined value X and equal to or smaller than a predetermined value Y (≥X). If the reception number is within the range, the amount indicates a desired overlaid amount, which means that the sheet is normal. Therefore, the sequence proceeds to step S922. In step S922, after waiting for a predetermined time, if a trailing edge of a last sheet of sheets conveyed in an overlaid state is not detected in step S923, the sequence returns to step S905 to monitor a state of a next overlaid portion. In the meantime, in step S923, if the trailing edge of the last sheet is detected, after the last sheet is delivered to the main body 300, the feeding operation in this job is completed.

A sheet is conveyed with an overlaid amount 50 mm of the preceding sheet and the subsequent sheet under the condition illustrated in FIG. 8B, that is, the sheet conveyance speed of 500 mm/s and an interval 20 ms (10 mm) when the overlaid state of the sheets is detected. In this case, if an overlaid amount is a predetermined overlaid amount 50 mm, points where it is detected that the sheets are two are 5 to 6. Therefore, the predetermined value X is 5 and the predetermined value Y is 6. If the overlaid amount of the sheets is changed from 50 mm under the same condition as the above, it should be noted that the overlaid amount of the sheets does not become smaller than an interval when the overlaid state of the sheets is detected.

In step S921, if the reception number of a level in the two sheet overlaid state is not equal to or larger than a predetermined value X and not equal to or smaller than a predetermined value Y (≥X), in step S924, it is determined whether the reception number of a level in the two sheet overlaid state is larger than the predetermined value Y. As a result, if the reception number of a level is larger than the predetermined value Y, the sequence proceeds to step S925. In step S925, it is determined that the amount is larger than a desired overlaid amount so that it is double feeding.

The conveyance of sheets is stopped (S926) and the occurrence of sheet double feeding is displayed on the operation portion 302 (S927). Continuously, it is monitored until the sheet on the sheet conveying path is removed (S928). If the removal is detected, the display of double feeding on the operation portion 302 is cleared in step S929 and the feeding operation is resumed in step S930 and the sequence returns to step S902 from W.

In the meantime, in step S924, if the reception number of a level in the two sheet overlaid state is not larger than the predetermined value Y, which means that the reception number is smaller than the predetermined value X, the sequence proceeds to step S931. In step S931, it is determined that the amount is smaller than a desired overlaid amount so that the subsequent sheet is delayed. In step S932, the sheet conveyance is stopped and the occurrence of sheet double feeding is displayed on the operation portion 302 (S933). Continuously, it is monitored until the sheet on the sheet conveying path is removed (S934). If the removal is detected, the display of the double feeding on the operation portion 302 is cleared in step S935 and the feeding operation is resumed in step S936 and the sequence returns to step S902 from W.

Next, a double feed detection processing at the time of feeding one sheet when the sequence proceeds from step S902 to U will be described. First, in step S937, the sheet detecting sensor 24 monitors the leading edge of the sheet to detect the leading edge and wait for a predetermined time (S938). Thereafter, the transmission by the transmission side ultrasonic wave sensor 6 is performed in step S939 and the reception by the reception side ultrasonic wave sensor 7 is performed in step S940. In step S941, it is counted that the sheet is in a level in the two sheet overlaid state.

Next, in step S942, it is determined whether the received number reaches a value Z which is previously set. As a result, if the number does not reach the value Z, the sequence returns to step S938 and the transmission of the transmission side ultrasonic wave sensor 6 and the reception of the reception side ultrasonic wave sensor 7 are repeated.

If the received number reaches the preset value Z in step S942, the sequence proceeds to step S943 to determine whether the sheet is double fed based on the received data obtained Z times. As a result, if it is determined that the sheet is double fed, the sequence proceeds to step S944 to stop the sheet conveyance (S944) and display the occurrence of the sheet double feeding on the operation portion 302 (S945).

Continuously, it is monitored until the sheet on the sheet conveying path is removed (S946). If the removal is detected, the display of the double feeding on the operation portion 302 is cleared in step S947, the feeding operation is resumed in step S948 and the sequence returns to step S937. In step S943, if it is determined that the sheet is not double fed, after delivering the sheet to the main body 300, the feeding operation is completed.

In the embodiment, if it is determined that the sheet is delayed, the sheet conveyance is stopped until the jam recovery is performed. However, if the timing is corrected by notifying the delayed amount of the delayed sheet to the main body 300, there is no need to stop the conveyed sheet at the time of determination of delay.

Further, when depending on a size and a kind of the sheet, the overlaid amount of the preceding sheet and the subsequent sheet is changed, the values of X and Y where the reception number of the level where two sheets are overlaid is normal are correspondingly changed.

According to the embodiment as described above, substantially same effect as the first embodiment may be obtained. Specifically, if an intentionally overlaid portion is an appropriate width, it is not erroneously detected to be double feeding. If the overlaid portion is not an appropriate width, it is processed as double feeding or delay jam so that it is possible to stably convey the sheet from the feeding portion in an overlaid state.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims the benefit of Japanese Patent Application No. 2012-032552, filed Feb. 17, 2012, which is hereby incorporated by reference herein in its entirety.

What is claimed is:

1. A sheet feeding device, comprising:

a tray that supports a sheet;

a feeding portion that feeds the sheet on the tray in a state where an upstream edge in a feeding direction of a preceding sheet fed from the tray is overlaid with a downstream edge in a feeding direction of a subsequent sheet;

a detecting portion that detects an overlaid state of the preceding sheet and the subsequent sheet that are fed by the feeding portion; and a controller that controls the detecting portion so as to continuously detect the overlaid state of the sheet fed from the feeding portion at a predetermined number of detecting points along the sheet feeding direction at a predetermined time, determines the number of detecting points that detect the overlaid state based on a detection of the detecting portion, determines that the overlaid state is normal if the number of detecting points is in a predetermined range in which the number is equal to or larger than a first number and equal to or smaller than a second number which is larger than the first number based on the determined number of detecting points and determines that the overlaid state is a double feeding state where an overlaid amount is excessive if the number of detecting points exceeds the predetermined range and determines that the overlaid state is a delay overlaid state where the overlaid amount is small if the number of detecting points is smaller than the predetermined range.

2. The sheet feeding device according to claim 1, further comprising:

an escape conveying path that discharges the sheet from the feeding portion to an outside of the device, wherein the controller continues a feeding operation of the feeding portion if it is determined that the overlaid state is normal and stops a feeding operation of the feeding portion and feeds the preceding sheet and the subsequent sheet which are determined to be abnormal to the escape conveying path if it is determined that the overlaid state is abnormal.

3. The sheet feeding device according to claim 1, further comprising:

a display that displays a state of the device, wherein the controller continues a feeding operation of the feeding portion if it is determined that the overlaid state is normal and stops a feeding operation of the feeding portion and displays that it is determined to be abnormal on the display if it is determined that the overlaid state is abnormal.

4. The sheet feeding device according to claim 1, wherein if it is determined that the overlaid state is delay overlaid state, the controller notifies delay information of the delayed sheet to a downstream device that receives the sheet fed by the feeding portion in a downstream side of the sheet feeding direction and then delivers the sheet to the downstream device while continuing a predetermined feeding operation by the feeding portion.

5. The sheet feeding device according to claim 1, wherein the detecting portion is a pair of transmission side and reception side ultrasonic wave sensors which are disposed to be opposite to each other and inclined with respect to the sheet feeding direction with the sheet to be fed interposed therebetween and with a predetermined distance therebetween.

6. A sheet feeding device, comprising:

a tray that supports a sheet;

a feeding portion that feeds the sheet on the tray in a state where an upstream edge in a feeding direction of a preceding sheet fed from the tray is overlaid with a downstream edge in a feeding direction of a subsequent sheet;

a detecting portion that detects an overlaid state of the preceding sheet and the subsequent sheet that are fed by the feeding portion; and a controller that controls the detecting portion so as to continuously detect the overlaid state of the sheet fed from the feeding portion at a predetermined number of detecting points along the sheet feeding direction at a predetermined time, determines the number of detecting points that detect the overlaid state based on a detection of the detecting portion, determines that the overlaid state is normal if the number of detecting points is in a predetermined range in which the number is equal to or larger than a first number and equal to or smaller than a second number which is larger than the first number based on the determined number of detecting points and determines that the overlaid state is abnormal if the number of detecting points is out of the predetermined range, wherein if an overlaid amount of a trailing edge of the preceding sheet and a leading edge of the subsequent sheet is changed, the controller changes the number of detecting points in the predetermined range to determine the overlaid amount.

7. A sheet processing apparatus, comprising:

a sheet feeding device which includes:

a tray that supports a sheet;

a feeding portion that feeds the sheet on the tray in a state where an upstream edge in a feeding direction of a preceding sheet fed from the tray is overlaid with a downstream edge in a feeding direction of a subsequent sheet;

a detecting portion that detects an overlaid state of the preceding sheet and the subsequent sheet that are fed by the feeding portion;

a controller that controls the detecting portion so as to continuously detect the overlaid state of the sheet fed from the feeding portion at a predetermined number of detecting points along the sheet feeding direction at predetermined time, determines the number of detecting points that detect the overlaid state based on a detection of the detecting portion, determines that the overlaid state is normal if the number of detecting points is in a predetermined range in which the number is equal to or larger than a first number and equal to or smaller than a second number which is larger than the first number based on the determined number of detecting points and determines that the overlaid state is a double feeding state where an overlaid amount is excessive if the number of detecting points exceeds the predetermined range and determines that the overlaid state is a delay overlaid state where the overlaid amount is too small if the number of detecting points is smaller than the predetermined range; and a sheet processing portion that performs a processing on a sheet fed from the sheet feeding device.

8. The sheet processing apparatus according to claim 7, further comprising:

an escape conveying path that discharges the sheet from the feeding portion to an outside of the device, wherein the controller continues a feeding operation of the feeding portion if it is determined that the overlaid state is normal and stops a feeding operation of the feeding portion and feeds the preceding sheet and the subsequent sheet which are determined to be abnormal to the escape conveying path if it is determined that the overlaid state is abnormal.

9. The sheet processing apparatus according to claim 7, further comprising:

a display that displays a state of the device, wherein the controller continues a feeding operation of the feeding portion if it is determined that the overlaid state is normal and stops a feeding operation of the feeding portion and displays that it is determined to be abnormal on the display if it is determined that the overlaid state is abnormal.

10. The sheet processing apparatus according to claim 7, wherein if it is determined that the overlaid state is the delay overlaid state, the controller notifies delay information of the delayed sheet to a downstream device that receives the sheet fed by the feeding portion in a downstream side of the sheet feeding direction and then delivers the sheet to the downstream device while continuing a predetermined feeding operation by the feeding portion.

11. The sheet processing apparatus according to claim 7, wherein the detecting portion is a pair of transmission side and reception side ultrasonic wave sensors which are disposed to be opposite to each other and inclined with respect to the sheet feeding direction with the sheet to be fed interposed therebetween and with a predetermined distance therebetween.

12. The sheet processing apparatus according to claim 7, wherein the sheet processing portion is an image forming portion that forms an image on the sheet.

13. The sheet processing apparatus according to claim 7, wherein the sheet processing portion is a post-processing portion that performs a post-processing on the sheet on which an image is formed.

14. A sheet processing apparatus, comprising:

a tray that supports a sheet;

a feeding portion that feeds the sheet on the tray in a state where an upstream edge in a feeding direction of a preceding sheet fed from the tray is overlaid with a downstream edge in a feeding direction of a subsequent sheet;

a detecting portion that detects an overlaid state of the preceding sheet and the subsequent sheet that are fed by the feeding portion; and a controller that controls the detecting portion so as to continuously detect the overlaid state of the sheet fed from the feeding portion at a predetermined number of detecting points along the sheet feeding direction at a predetermined time, determines the number of detecting points that detect the overlaid state based on a detection of the detecting portion, determines that the overlaid state is normal if the number of detecting points is in a predetermined range in which the number is equal to or larger than a first number and equal to or smaller than a second number which is larger than the first number based on the determined number of detecting points and determines that the overlaid state is abnormal if the number of detecting points is out of the predetermined range, wherein if an overlaid amount of a trailing edge of the preceding sheet and a leading edge of the subsequent sheet is changed, the controller changes the number of detecting points in the predetermined range to determine the overlaid amount.

* * * * *